US008758972B2

(12) United States Patent
Honda et al.

(10) Patent No.: US 8,758,972 B2
(45) Date of Patent: Jun. 24, 2014

(54) TONER, METHOD OF PRODUCING TONER, AND IMAGE FORMING METHOD

(75) Inventors: Takahiro Honda, Fujinomiya (JP); Yohichiroh Watanabe, Fuji (JP); Yoshihiro Norikane, Yokohama (JP); Shinji Ohtani, Shizuoka-ken (JP)

(73) Assignee: Ricoh Company, Limited, Tokyo (JP)

( * ) Notice: Subject to any disclaimer, the term of this patent is extended or adjusted under 35 U.S.C. 154(b) by 735 days.

(21) Appl. No.: 12/497,978

(22) Filed: Jul. 6, 2009

(65) Prior Publication Data

US 2010/0003613 A1 Jan. 7, 2010

(30) Foreign Application Priority Data

Jul. 7, 2008 (JP) ..... 2008-176606
Apr. 3, 2009 (JP) ..... 2009-090667

(51) Int. Cl.
*G03G 5/00* (2006.01)

(52) U.S. Cl.
USPC ..... 430/137.1; 430/108.4

(58) Field of Classification Search
USPC ..... 430/110.4, 137.14, 124.1, 137.1
See application file for complete search history.

(56) References Cited

U.S. PATENT DOCUMENTS

2008/0063971 A1 3/2008 Watanabe et al.
2008/0286679 A1 11/2008 Norikane et al.
2008/0292985 A1 11/2008 Suzuki et al.
2009/0170018 A1* 7/2009 Kuramoto et al. ..... 430/108.22
2010/0021209 A1* 1/2010 Watanabe et al. ..... 399/252

FOREIGN PATENT DOCUMENTS

| | | | |
|---|---|---|---|
| CN | 1845010 | A | 10/2006 |
| EP | 1 703 332 | A2 | 9/2006 |
| JP | 7-152202 | | 6/1995 |
| JP | 2527473 | | 6/1996 |
| JP | 2528511 | | 6/1996 |
| JP | 2002-287409 | | 10/2002 |
| JP | 3786034 | | 3/2006 |
| JP | 3786035 | | 3/2006 |
| JP | 3952817 | | 5/2007 |
| JP | 2007-212905 | | 8/2007 |
| WO | WO 2007/105737 | A1 | 9/2007 |

OTHER PUBLICATIONS

Office Action issued Jun. 9, 2011 in China Application No. 200910158760.4.

* cited by examiner

*Primary Examiner* — Stewart Fraser
(74) *Attorney, Agent, or Firm* — Oblon, Spivak, McClelland, Maier & Neustadt, L.L.P.

(57) ABSTRACT

A toner produced by a method including dissolving or dispersing toner components comprising a resin, a colorant, and a release agent in a solvent to prepare a toner components liquid, discharging the toner components liquid from multiple nozzles provided on a thin film by vibrating the thin film by a mechanical vibration unit to form liquid droplets, and drying the liquid droplets into solid particles of the toner. The particle diameter distribution that is a ratio of a weight average particle diameter to a number average particle diameter of the toner is between 1.00 and 1.15, and a weight average particle diameter of the release agent in the toner is between 1% and 30% of an aperture diameter of the nozzle.

11 Claims, 18 Drawing Sheets

RANK 5

RANK 3

RANK 1

TONER, METHOD OF PRODUCING TONER, AND IMAGE FORMING METHOD

BACKGROUND OF THE INVENTION

1. Field of the Invention

The present invention relates to a toner for use in electrophotography. The present invention also relates to a method of producing toner and an image forming method using the toner.

2. Discussion of the Background

In the fields of electrophotography and electrostatic recording, latent images are generally developed with toner. Methods of developing latent image are broadly classified into methods using a two-component developer that includes a toner and a carrier, and methods using a one-component developer that includes a toner and no carrier. The former methods (hereinafter "two-component developing methods") generally produce high grade image but have disadvantages that carrier is likely to deteriorate with time and the mixing ratio of carrier and toner is likely to fluctuate with time, which result in a shorter lifespan of the developer and unreliable image formation. In addition, the former methods do not contribute to simple maintenance and downsizing of image forming apparatus. In view of the above situation, the latter methods (hereinafter "one-component developing methods") have attracted attention recently.

In a typical one-component developing method, a toner (i.e., a one-component developer) is fed to an electrostatic latent image formed on an electrostatic latent image bearing member, by at least one toner feeding member, to form the electrostatic latent image into a toner image. Generally, the toner feeding member feeds toner in the form of a layer. The layer of toner is preferably as thin as possible. If the layer is thick, toner particles present near the surface of the layer are sufficiently charged by a charging member while the other toner particles are not. However, if the layer is too thin, in a case in which the toner includes a release agent (such as a wax), the release agent is likely to exude from the toner with time by continuous application of mechanical stress from a toner layer forming member. As a result, the background portion of a resultant image may be soiled with toner particles (this phenomenon is hereinafter referred to as background fouling) because chargeability of the toner deteriorates. Further, the release agent may accumulate and form undesired thin film thereof on image forming members.

In one-component developing methods, the resultant image quality largely depends on the particle diameter distribution of toner. When the particle diameter distribution is wide, toner particles are selectively and successively consumed in order of particle diameter, from small to large (this phenomenon is hereinafter referred to as selective development). It may be also stated that toner particles are selectively and successively consumed in order of charge quantity, from large to small. Accordingly, the resultant image quality may deteriorate along with increase of the particle diameter of toner particles used for development. In addition, background fouling and color tone variation may be caused with time because chargeability of toner particles may deteriorate with time.

In attempting to solve the above-described problem, Japanese Patent No. (hereinafter JP) 2527473 and JP 2528511 each disclose a toner including an initial toner and a supplemental toner. The initial toner and the supplemental toner include different kinds and amounts of external additives, or the initial toner and the supplemental toner are surface-treated in different ways, intentionally, so that they have different charge quantities. However, these attempts are insufficient to prevent deterioration of image quality with time.

It is to be said that the best way to prevent deterioration of image quality is to narrow the particle diameter distribution of toner as much as possible. Various attempts have been made to narrow the particle diameter distribution of toner. For example, a pulverization method, which is one of toner production methods, has been improved to narrow the particle diameter distribution of toner, but the improvement is still insufficient. Here, in a typical pulverization method, toner components such as a binder resin and a colorant are melt-kneaded, the melt-kneaded mixture is pulverized into particles, and the particles are classified by size.

Recently, polymerization methods such as a suspension polymerization method, an emulsion aggregation method, and a polymer dissolution suspension method are also widely employed as toner production methods, as described in JP-A 07-152202 and JP-A 2007-212905, for example. Polymerization methods generally have an advantage in producing toner with a narrow particle diameter distribution compared to pulverization methods. However, polymerization methods are still insufficient to prevent selective development.

JP 3786037 discloses a toner production method in which microdroplets of fluid raw materials are formed using piezoelectric pulse and then dried into toner particles. JP3952817 discloses a toner production method in which microdroplets of fluid raw materials are formed using thermal expansion within a nozzle and then dried into toner particles. JP 3786035 discloses a toner production method in which microdroplets of fluid raw materials are formed using an acoustic lens and then dried into toner particles. However, these methods have poor productivity because the number of droplets discharged from a nozzle per unit time is small. In addition, it may be difficult to prevent coalescence of droplets, which results in a broad particle diameter distribution of the resultant particles.

Another approach involves a toner production method in which microdroplets of raw materials are formed using film vibration or liquid vibration, and then the microdroplets are discharged from a nozzle while riding on rotation feeding airflow. In this case, coalescence of droplets may be prevented, however, the resultant particle diameter distribution may not be narrow to solve the problem of selective development.

SUMMARY OF THE INVENTION

Accordingly, an object of the present invention is to provide a toner having a narrow particle diameter distribution which does not cause selective development in one-component developing methods.

Another object of the present invention is to provide a method of producing toner which effectively produces a toner having a narrow particle diameter distribution without causing nozzle clogging, because release agent particles are finely dispersed in the toner.

Yet another object of the present invention is to provide an image forming method which can produce high definition and high resolution images for an extended period of time.

These and other objects of the present invention, either individually or in combinations thereof, as hereinafter will become more readily apparent can be attained by a toner produced by a method comprising:

dissolving or dispersing toner components comprising a resin, a colorant, and a release agent in a solvent to prepare a toner components liquid;

discharging the toner components liquid from multiple nozzles provided on a thin film by vibrating the thin film by a mechanical vibration unit to form liquid droplets; and drying the liquid droplets into solid particles of the toner, wherein a particle diameter distribution that is a ratio of a weight average particle diameter to a number average particle diameter of the toner is between 1.00 and 1.15, and a weight average particle diameter of the release agent in the toner is between 1% and 30% of an aperture diameter of the nozzle; and a method of producing the toner and an image forming method using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

To form liquid droplets of a toner components liquid in gas phase, a single-fluid nozzle (pressurization nozzle) that sprays a liquid by pressurizing the liquid, a multi-fluid nozzle that sprays a liquid by mixing the liquid with a compressed gas, and a rotating-disk spraying device that forms liquid droplets using centrifugal force of the rotating disk may be used, for example. To produce a toner having a small particle diameter, single-fluid nozzles and rotating-disk spraying devices are preferable. Multiple-fluid nozzles may be external mixing double-fluid nozzles, for example. In attempting to produce a toner having a much smaller particle diameter, various types of nozzles such as internal mixing double-fluid nozzles and quadruple-fluid nozzles have been developed. For the same purpose, disks of rotating-disk spraying devices are improved to have a dish, bowl, or multi-blade shape, for example. However, disadvantageously, toners produced using the above nozzles or spraying devices have a wide particle diameter distribution and need classification.

In an exemplary method of producing toner of the present invention, a toner components liquid is periodically discharged from multiple nozzles provided on a thin film. The multiple nozzles each have the same aperture diameter. The thin film is vibrated by a mechanical vibration unit so that liquid droplets of the toner components liquid are periodically formed.

An exemplary toner of the present invention may be produced using a toner production apparatus which is capable of discharging a toner components liquid from multiple nozzles provided on a thin film by vibrating the thin film by a mechanical vibration unit. Such a toner production apparatus forms liquid droplets of the toner components liquid periodically.

The mechanical vibration unit vibrates in a vertical direction relative to the thin film. Exemplary embodiments of such mechanical vibration units include a horn vibrator and a ring vibrator, for example. An exemplary horn vibrator includes a vibrating surface that is provided parallel to the thin film. The vibrating surface vibrates in a vertical direction. An exemplary ring vibrator includes a circular vibration generating unit that is provided surrounding the nozzles on the thin film.

For the sake of simplicity, the same reference number will be given to identical constituent elements such as parts and materials having the same functions and redundant descriptions thereof omitted unless otherwise stated.

Figure 1:
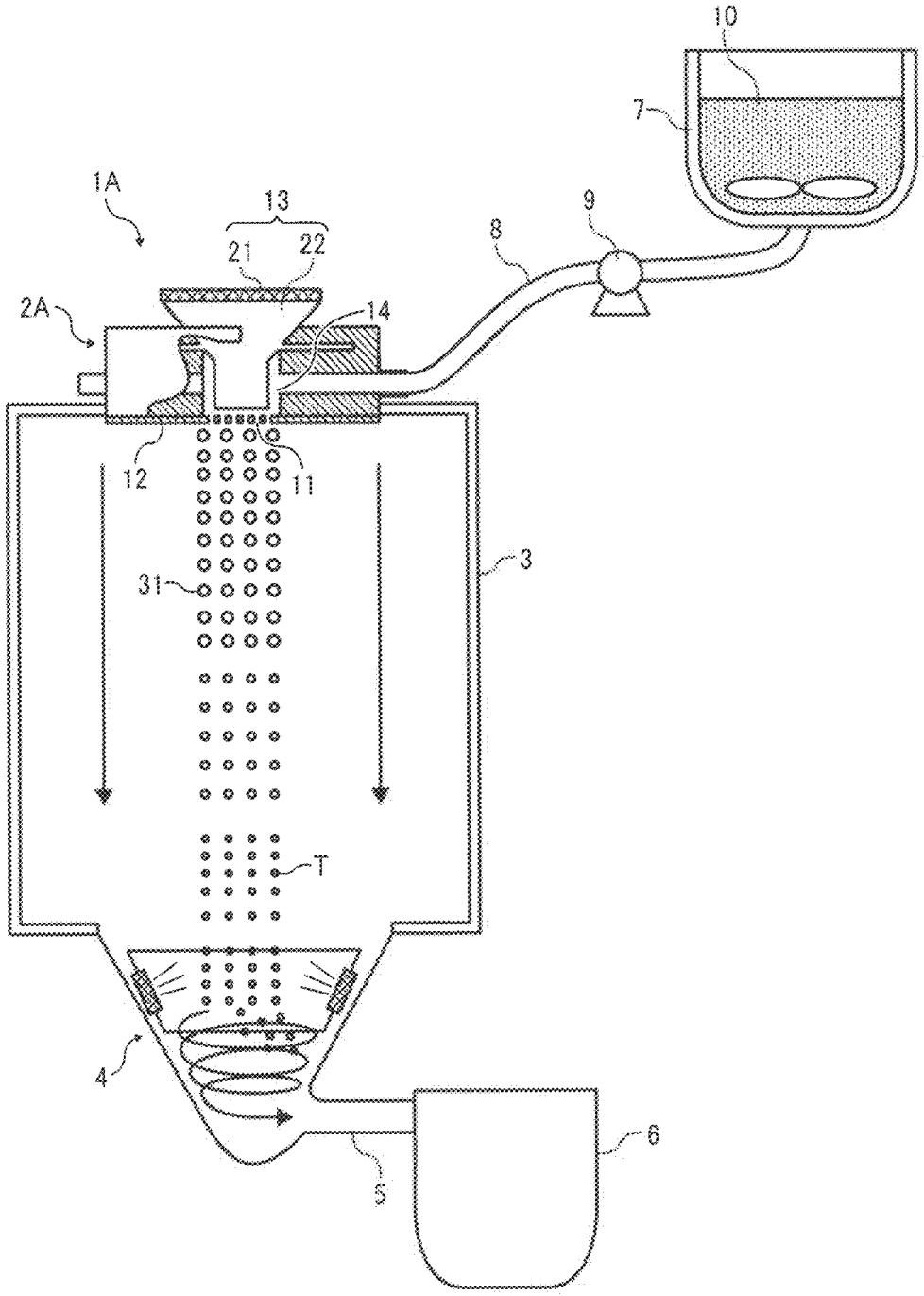
FIG. 1 is a schematic view illustrating an exemplary embodiment of a toner production apparatus including a horn vibrator.

FIG. 1 is a schematic view illustrating an exemplary embodiment of a toner production apparatus 1A including a horn vibrator.

The toner production apparatus 1A includes a liquid droplet injection unit 2A, a toner particle formation part 3, a toner collection part 4, a toner retention part 6, a raw material container 7, a pipe 8, and a pump 9. The liquid droplet injection unit 2A includes a horn vibrator, and is configured to discharge a toner components liquid 10 to form liquid droplets 31 thereof. The toner components liquid 10 comprises a resin and a colorant. The toner particle formation part 3 is configured to form toner particles T by solidifying the liquid droplets 31 of the toner components liquid 10 discharged from the liquid droplet injection unit 2A. The toner collection part 4 is configured to collect the toner particles T formed in the toner particle formation part 3. The toner retention part 6 is configured to retain the toner particles T transported from the toner collection part 4 through a tube 5. The raw material container 7 is configured to contain the toner components liquid 10. The pipe 8 is configured to pass the toner components liquid 10 from the raw material container 7 to the liquid droplet injection unit 2A. The pump 9 is configured to supply the toner components liquid 10 by pressure when the apparatus starts operation, for example.

The toner components liquid 10 is self-supplied from the raw material container 7 when the liquid droplet injection unit 2A discharges liquid droplets 31. When the apparatus starts operation, the toner components liquid 10 is supplementarily supplied by the pump 9. The toner components liquid 10 is a solution or dispersion in which toner components including a resin, a colorant, and a release agent are dissolved or dispersed in a solvent.

Figure 2:
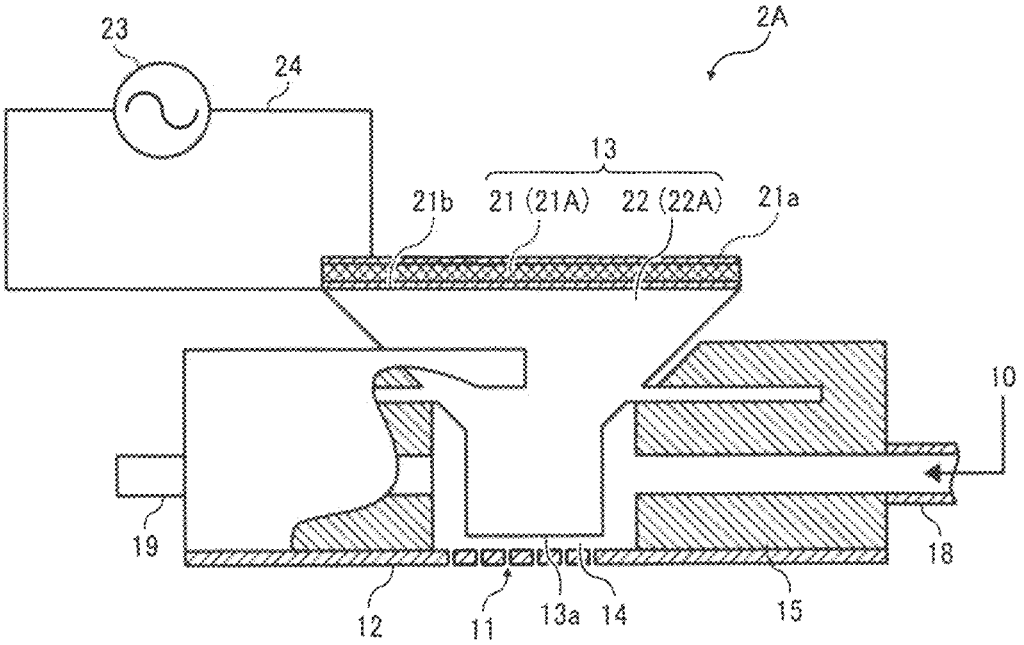
FIG. 2 is a schematic cross-sectional view illustrating an embodiment of the liquid droplet injection unit illustrated in FIG. 1.
Figure 3:
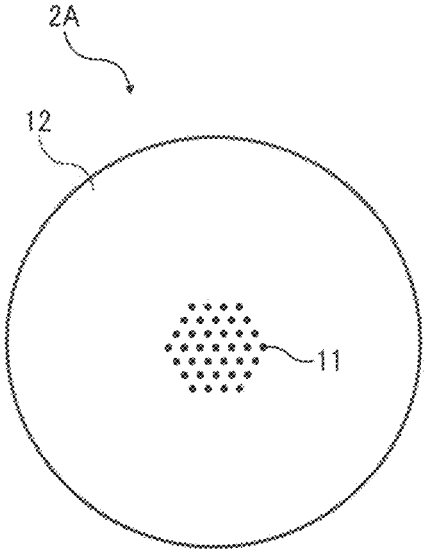
FIG. 3 is a schematic bottom view illustrating an embodiment of the liquid droplet injection unit illustrated in FIG. 1.

FIG. 2 is a schematic cross-sectional view illustrating an embodiment of the liquid droplet injection unit 2A. FIG. 3 is a schematic bottom view illustrating an embodiment of the liquid droplet injection unit 2A.

The liquid droplet injection unit 2A includes a thin film 12, a mechanical vibration unit 13 (hereinafter simply "vibration unit 13"), and a flow path member 15. The thin film 12 includes multiple nozzles 11. The vibration unit 13 is configured to vibrate the thin film 12. The flow path member 15 forms a liquid flow path and supplies the toner components liquid 10 to a retention part 14 that is formed between the thin film 12 and the vibration unit 13.

The thin film 12 that includes the multiple nozzles 11 is provided parallel to a vibrating surface 13*a* of the vibration unit 13. A part of the thin film 12 is fixed to the flow path member 15 with solder or a binder resin which does not dissolve in the toner components liquid 10. The thin film 12 is provided substantially vertical to the direction of vibration of the vibration unit 13. A communication member 24 transmits an electrical signal from a driving signal generating source 23 to the upper and lower surfaces of a vibration generating unit 21 of the vibration unit 13 so that the electrical signal is converted into mechanical vibration. Preferably, the communication member 24 may be a lead wire of which the surface is insulation-coated. The vibration unit 13 preferably includes a vibrator having a large amplitude, such as a horn vibrator and a bolted Langevin vibrator, in order to effectively and reliably produce toner.

The vibration unit 13 includes the vibration generating unit 21 a vibration amplifying unit 22. The vibration generating unit 21 generates a vibration, and the vibration amplifying unit 22 amplifies the vibration generated by the vibration generating unit 21. Upon application of a driving voltage (driving signal) having a specific frequency from the driving signal generating source 23 to electrodes 21*a* and 21*b* of the vibration generating unit 21, a vibration is generated by the vibration generating unit 21 and amplified by the vibration amplifying unit 22. As a result, the vibrating surface 13*a* periodically vibrates, and the thin film 12 also vibrates at a specific frequency due to periodical application of pressure from the vibrating surface 13*a*.

The vibration unit 13 is configured to reliably apply vertical vibration to the thin film 12 at a constant frequency. Exemplary embodiments of the vibration unit 13 include a piezoelectric substance 21A which excites bimorph flexural vibration. The piezoelectric substance 21A has a function of converting electrical energy into mechanical energy. Flexural vibration is excited upon application of voltage, thereby vibrating the thin film 12.

The piezoelectric substance 21A may be a piezoelectric ceramic such as lead zirconate titanate (PZT), for example. Because of vibrating with a small displacement, such a substance is often laminated when used as the piezoelectric substance 21A. Alternatively, the piezoelectric substance 21A may be a piezoelectric polymer such as polyvinylidene fluoride (PVDF) or a single crystal of quartz, $LiNbO_3$, $LiTaO_3$, or $KNbO_3$, for example.

The vibrating surface 13*a* is provided in parallel with the thin film 12 so that the thin film 12 is vibrated in vertical direction.

The vibration unit 13 illustrated in FIG. 2 is a horn vibrator. In the horn vibrator, the amplitude of the vibration generating unit 21 (such as the piezoelectric substance 21A) can be amplified by the vibration amplifying unit 22 (such as a horn 22A). Therefore, the vibration generating unit 21 itself need not vibrate at a large amplitude, reducing mechanical load to the vibration generating unit 21. Accordingly, a lifespan of the apparatus can be lengthened.

Figure 4:
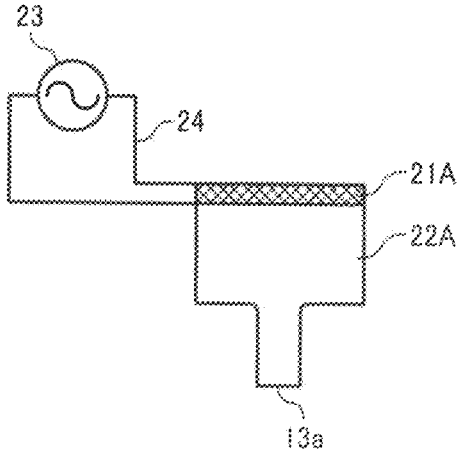
FIGS. 4 to 6 are schematic views illustrating exemplary embodiments of the horn vibrator.
Figure 5:
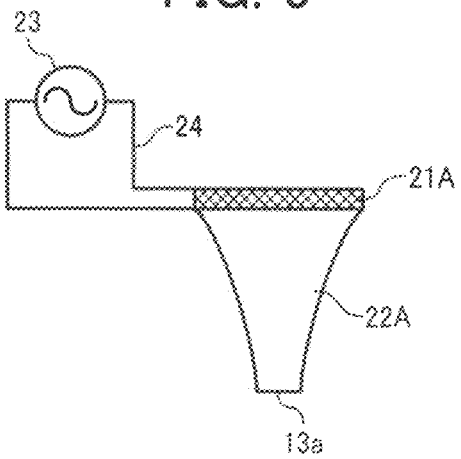
Figure 6:
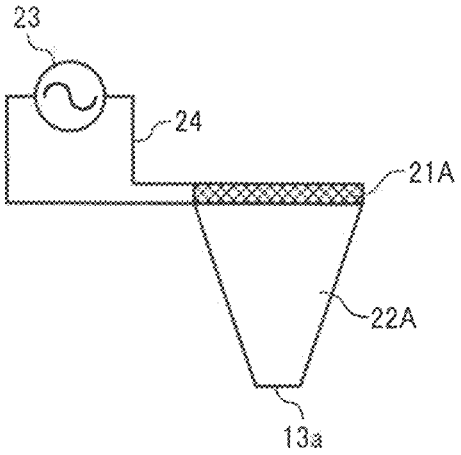

Exemplary embodiments of the horn vibrator include a step-type horn vibrator as illustrated in FIG. 4, an exponential-type horn vibrator as illustrated in FIG. 5, and a conical-type horn vibrator as illustrated in FIG. 6, for example. In these horn vibrators, the piezoelectric substance 21A is provided on a larger surface of the horn 22A so that the horn 22A is effectively excited to vibrate by vertical vibration of the piezoelectric substance 21A. The vibrating surface 13*a* is provided on a smaller surface of the horn 22A so that the vibrating surface 13*a* vibrates at the maximum amplitude. The communication member 24 (e.g., a lead wire) is provided on the upper and lower surfaces of the piezoelectric substance 21A so that an alternating voltage signal is transmitted from the driving signal generating source 23. The shape of the horn vibrator is designed so that the vibrating surface 13*a* becomes the maximum vibrating surface in the horn vibrator.

Alternatively, the vibration unit 13 may be a bolted Langevin vibrator having high strength, for example. Since a piezoelectric ceramic is mechanically connected, the bolted Langevin vibrator is unlikely to be damaged even when vibrating at a large amplitude.

Referring back to FIG. 2, at least one liquid supplying tube 18 is provided on the retention part 14. The liquid supplying tube 18 is configured to introduce the toner components liquid 10 to the retention part 14 through a liquid path. A bubble discharging tube 19 may be optionally provided, if desired. The liquid droplet injection unit 2A is provided on the top surface of the toner particle formation part 3 by a support member, not shown, that is attached to the flow path member 15. Alternatively, the liquid droplet injection unit 2A may be provided on a side surface or the bottom surface of the toner particle formation part 3.

In general, the smaller the frequency of the generated vibration, the larger the size of the vibration unit 13. The vibration unit 13 may be directly drilled to form a retention part according to a required frequency. It may be also possible to vibrate the retention part entirely. In this case, a surface to which a thin film including multiple nozzles is attached is regarded as a vibrating surface.

Figure 7:
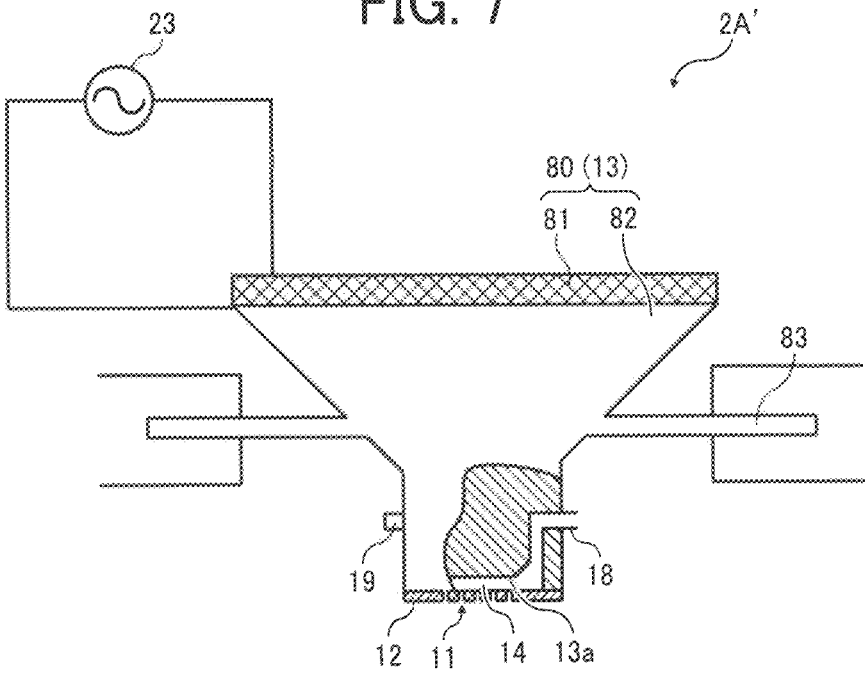
FIGS. 7 to 9 are schematic cross-sectional views illustrating another exemplary embodiment of a liquid droplet injection unit.
Figure 8:
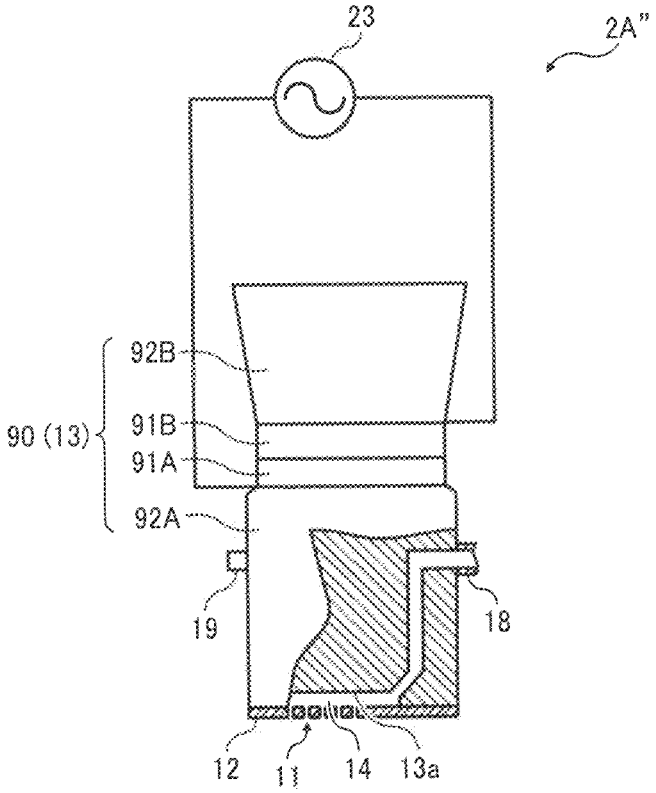

FIGS. 7 and 8 are schematic views illustrating other exemplary embodiments of liquid droplet injection units 2A' and 2A", respectively.

Referring to FIG. 7, the liquid droplet injection unit 2A' includes a horn vibrator 80 (i.e., the vibration unit 13) that includes a piezoelectric substance 81 serving as a vibration generating part and a horn 82 serving as a vibration amplifying part. A retention part 14 is formed inside the horn 82. The liquid droplet injection unit 2A' is preferably provided on a side surface of the toner particle formation part 3 by a flange 83 that is integrated with the horn 82. In view of reducing vibration loss, the liquid droplet injection unit 2A' may be fixed by an elastic body, not shown.

Referring to FIG. 8, the liquid droplet injection unit 2A" includes a bolted Langevin vibrator 90 (i.e., the vibration unit 13) that includes piezoelectric substances 91A and 91B serving as a vibration generating part and horns 92A and 92B serving as a vibration amplifying part. The vibration generating part (91A and 91B) and the vibration amplifying part (92A and 92B) are tightly fixed together mechanically. A retention part 14 is formed inside the horn 92A. The size of the vibrator may be large according to a required frequency. In this case, as illustrated, a liquid flow path and the retention part 14 may be provided inside the vibrator and a metallic thin film 12 including multiple nozzles 11 may be attached thereto.

Referring back to FIG. 1, only one liquid droplet injection unit 2A is provided on the toner particle formation part 3. From the viewpoint of productivity, it is more preferable that multiple liquid droplet injection units 2A are provided on the top surface of the toner particle formation part 3. The number of the liquid droplet injection unit 2A is preferably from 100 to 1,000 from the viewpoint of controllability. In this case, the toner components liquid 10 is supplied from the raw material container 7 to each retention parts 14 in each liquid droplet injection units 2A through the pipe 8. The toner components liquid 10 may be self-supplied from the raw material container 7 when the liquid droplet injection unit 2A discharges liquid droplets 31. Alternatively, the toner components liquid 10 may be supplementarily supplied by the pump 9.

Figure 9:
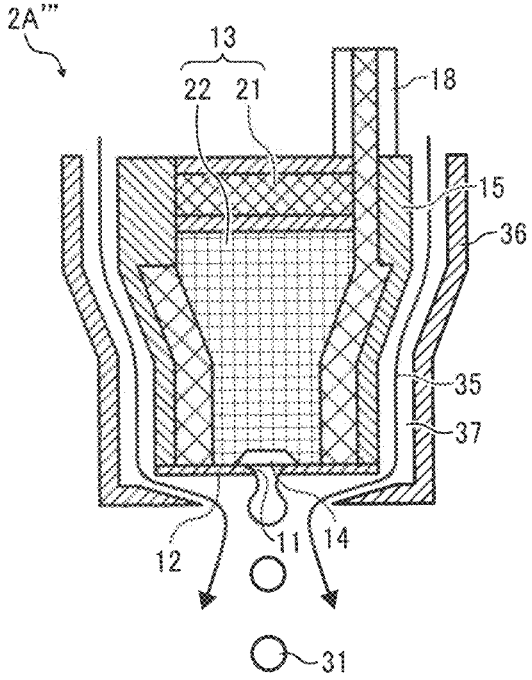

FIG. 9 is a schematic cross-sectional view illustrating another exemplary embodiment of a liquid droplet injection unit 2A'".

The liquid droplet injection unit 2A'" includes a horn vibrator serving as the vibration unit 13. A flow path member 15 is provided surrounding the vibration unit 13. The flow path member 15 is configured to supply the toner components liquid 10. A retention part 14 is provided inside a horn 22 so that the retention part 14 faces a thin film 12. An airflow path forming member 36 is provided surrounding the flow path member 15 so that an airflow path 37 is formed. An airflow 35 flows in the airflow path 37. To simplify the drawing, only one nozzle 11 is illustrated in FIG. 9, however, the thin film 12 includes multiple nozzles actually.

Figure 10:
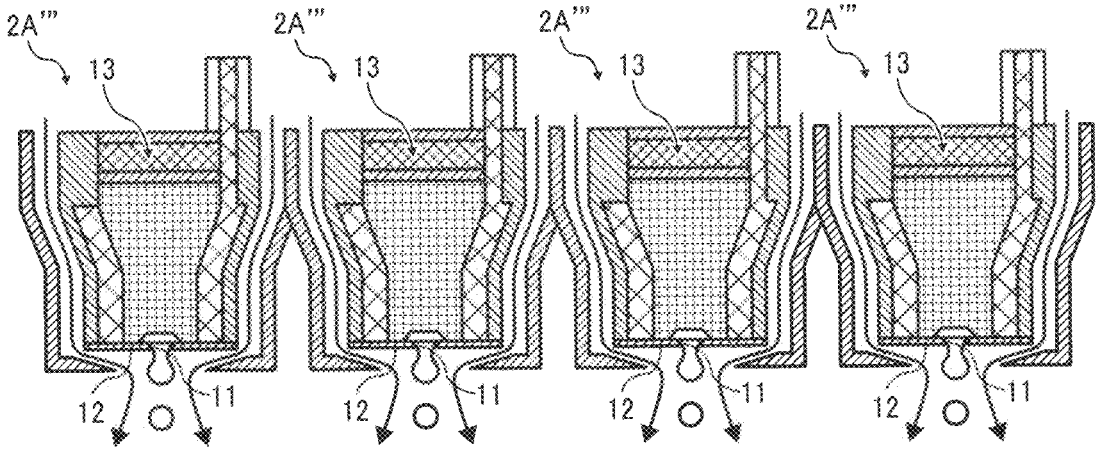
FIG. 10 is a schematic view illustrating an embodiment of multiple liquid droplet injection units.

As illustrated in FIG. 10, multiple liquid droplet injection units 2A'" may be provided on the top surface of the toner particle formation part 3. From the viewpoint of productivity and controllability, the number of the liquid droplet injection units 2A'" is preferably from 100 to 1,000.

Figure 11:
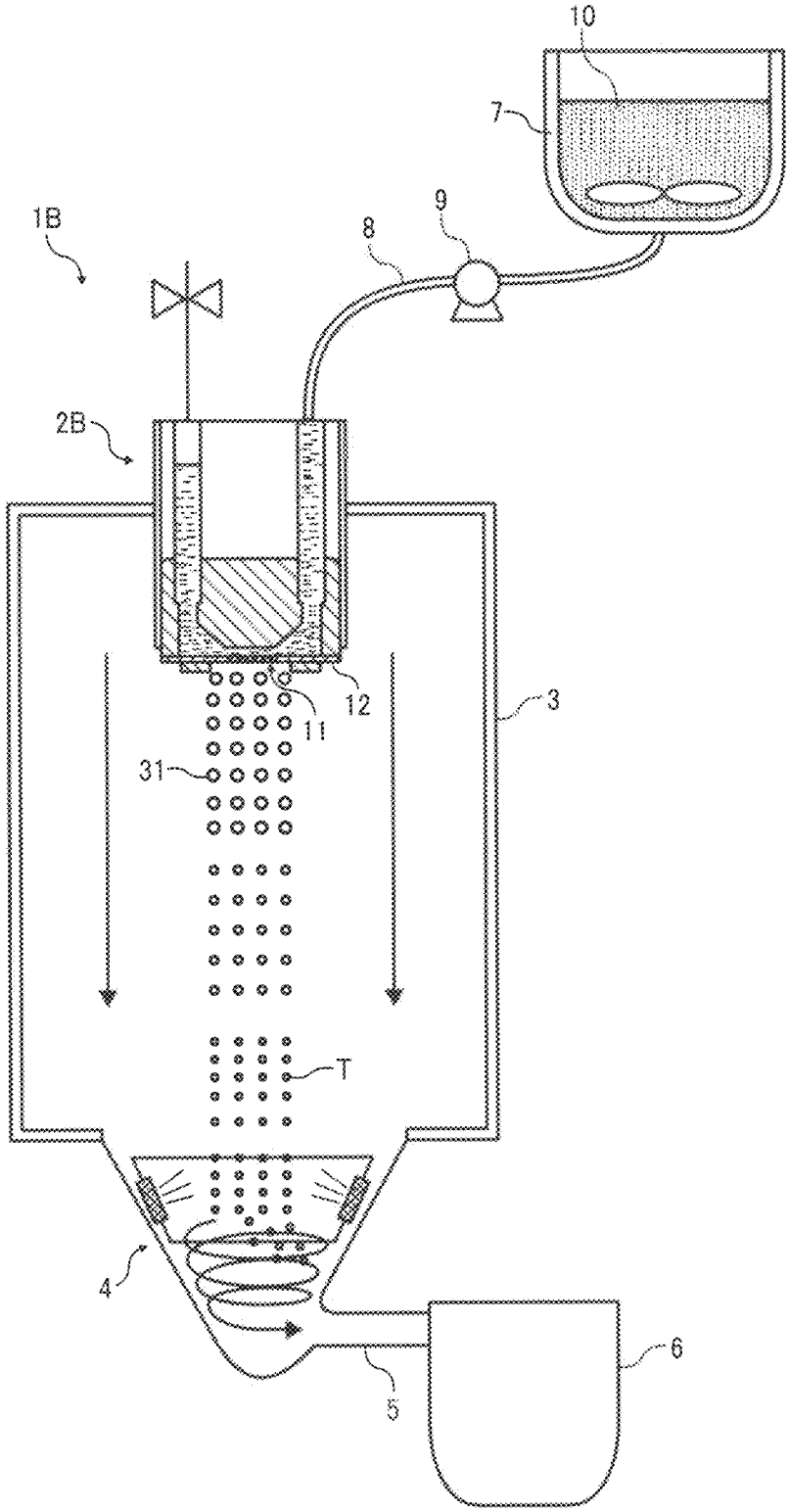
FIG. 11 is a schematic view illustrating another exemplary embodiment of a toner production apparatus including a ring vibrator.
Figure 12:
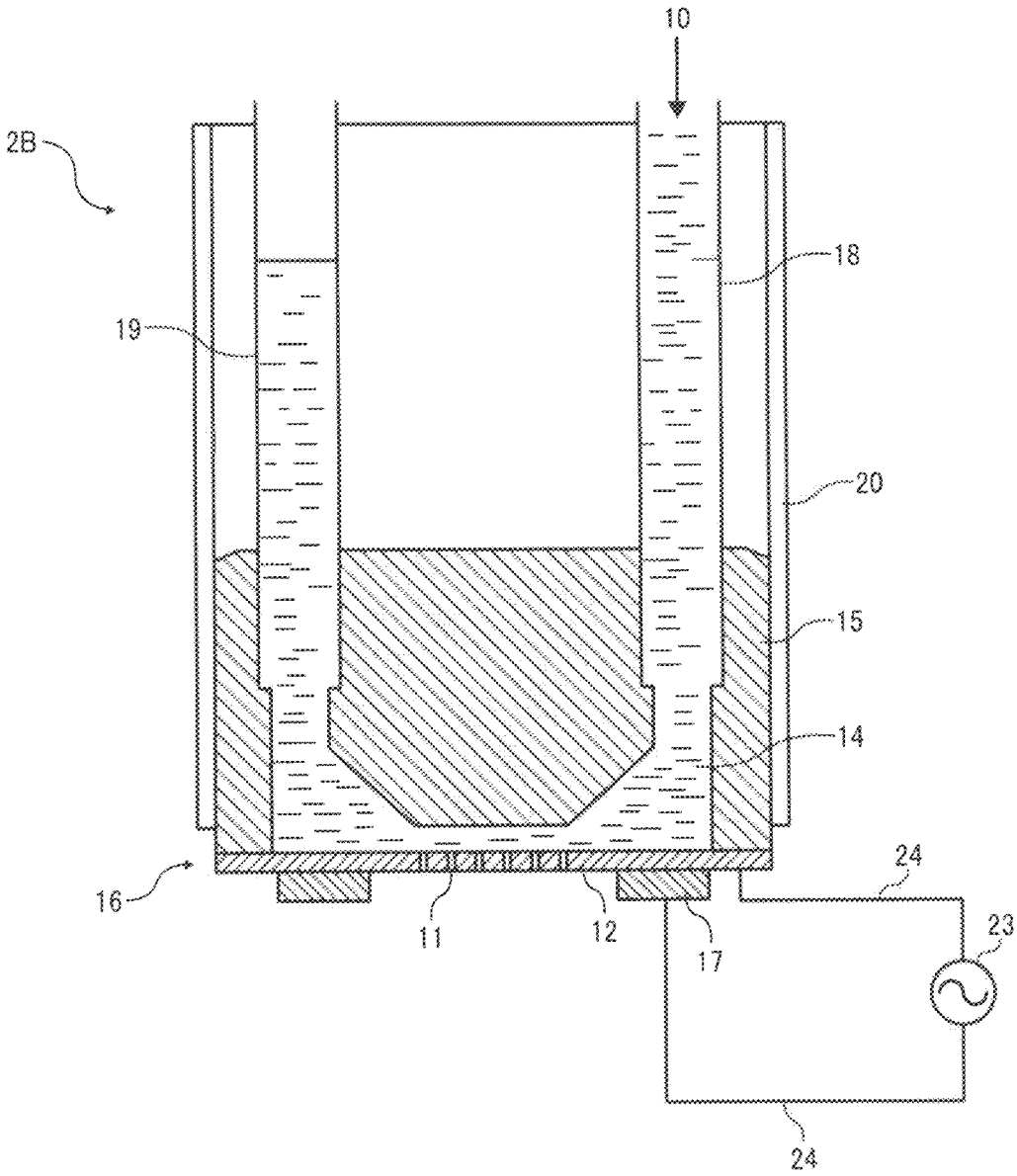
FIG. 12 is a schematic cross-sectional view illustrating an embodiment of the liquid droplet injection unit illustrated in FIG. 11.

FIG. 11 is a schematic view illustrating another exemplary embodiment of a toner production apparatus 1B including a ring vibrator. The toner production apparatus 1B includes a liquid droplet injection unit 2B. FIG. 12 is a schematic cross-sectional view illustrating an embodiment of the liquid droplet injection unit 2B.

Referring to FIG. 12, the liquid droplet injection unit 2B includes a liquid droplet forming unit 16 and a flow path member 15. The liquid droplet forming unit 16 is configured to discharge a toner components liquid 10 comprising a resin and a colorant to form liquid droplets thereof. The flow path member 15 is configured to form a liquid flow path and supplies the toner components liquid 10 to a retention part 14.

Figure 13:
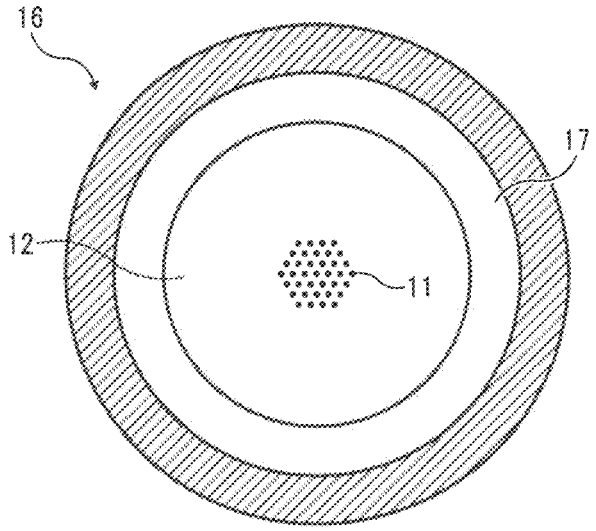
FIG. 13 is a schematic bottom view illustrating an embodiment of the liquid droplet forming unit illustrated in FIG. 11.
Figure 14:
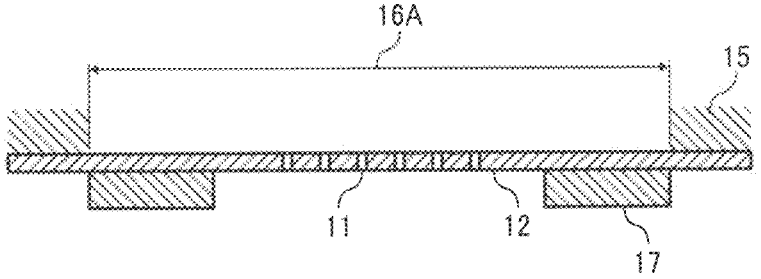
FIG. 14 is a schematic cross-sectional view illustrating an embodiment of the liquid droplet forming unit illustrated in FIG. 11.

FIG. 13 is a schematic bottom view illustrating an embodiment of the liquid droplet forming unit 16. FIG. 14 is a schematic cross-sectional view illustrating an embodiment of the liquid droplet forming unit 16.

The liquid droplet forming unit 16 includes a thin film 12 and a ring-shaped vibration generating unit 17. The thin film 12 includes multiple nozzles 11. The ring-shaped vibration generating unit 17 is configured to vibrate the thin film 12. The outermost portion (shaded portion in FIG. 13) of the thin film 12 is fixed to the flow path member 15 with solder or a binder resin which does not dissolve in the toner components liquid 10. The ring-shaped vibration generating unit 17 is provided on a periphery within a transformable region 16A (i.e., a region which is not fixed to the flow path member 15) of the thin film 12. Upon application of a driving voltage (driving signal) having a specific frequency from a driving signal generating source 23 through a communication member 24, the ring-shaped vibration generating unit 17 generates flexural vibration, for example.

Figure 15:
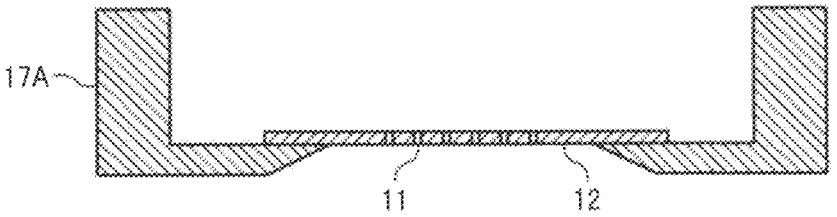
FIG. 15 is a schematic cross-sectional view illustrating another embodiment of the liquid droplet forming unit illustrated in FIG. 11.

FIG. 15 is a schematic cross-sectional view illustrating another embodiment of the liquid droplet forming unit 16.

Referring to FIG. 14, the ring-shaped vibration generating unit 17 is provided on a periphery within the transformable region 16A of the thin film 12. On the other hand, referring to FIG. 15, a ring-shaped vibration generating unit 17A supports a periphery of the thin film 12. Comparing FIG. 14 and FIG. 15, the amount of displacement of the thin film 12 may be larger in the embodiment of FIG. 14 than in the embodiment of FIG. 15. Therefore, in the embodiment of FIG. 14, multiple nozzles 11 can be provided on a relatively large area (having a diameter of 1 mm or more). As a result, a greater amount of liquid droplets can be simultaneously and reliably discharged from the multiple nozzles 11.

Figure 16:
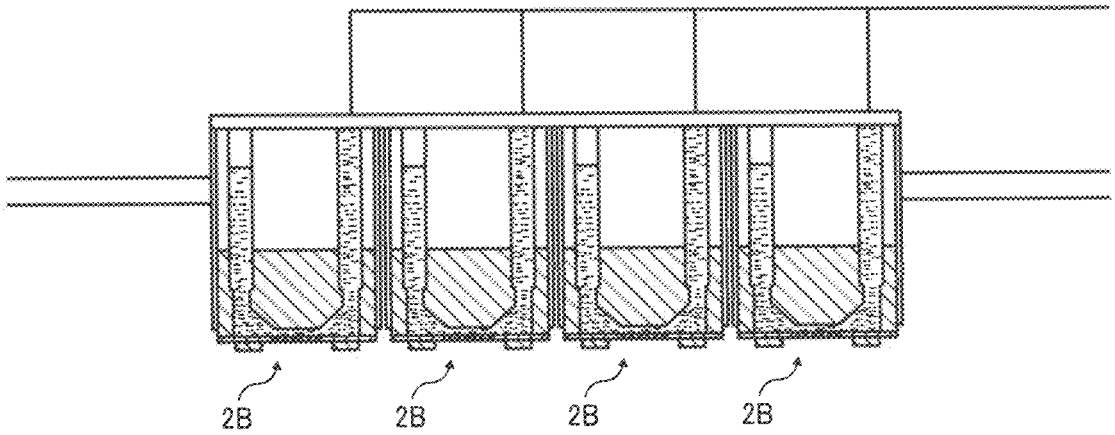
FIG. 16 is a schematic view illustrating another embodiment of multiple liquid droplet injection units.

Referring back to FIG. 11, only one liquid droplet injection unit 2B is provided on the toner particle formation part 3. From the viewpoint of productivity, as illustrated in FIG. 16, multiple liquid droplet injection units 2B may be preferably provided on the top surface of the toner particle formation part 3. The number of the liquid droplet injection unit 2B is preferably from 100 to 1,000 from the viewpoint of controllability. The toner components liquid 10 is supplied from the raw material container 7 to each liquid droplet injection units 2B through the pipe 8.

A mechanism of formation of liquid droplets by the liquid droplet injection units 2A and 2B is described below.

In the liquid droplet injection unit 2A or 2B, a vibration generated by the vibration unit 13 is propagated to the thin film 12 so that the thin film 12 periodically vibrates. The thin film 12 includes the multiple nozzles 11 that are provided within a relatively large area (having a diameter of 1 mm or more). The thin film 12 faces the retention part 14. Liquid droplets are reliably discharged from the multiple nozzles 11 by periodical vibration of the thin film 12.

Figure 17A:
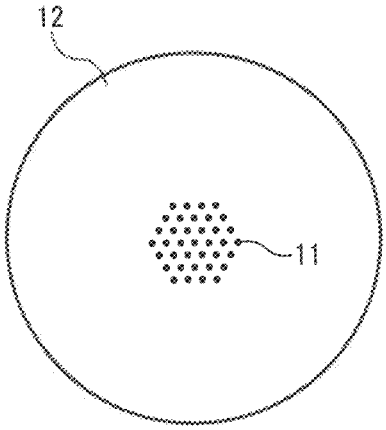
FIGS. 17A and 17B are schematic bottom and cross-sectional views, respectively, illustrating an exemplary embodiment of the thin film illustrated in FIG. 11.
Figure 17B:
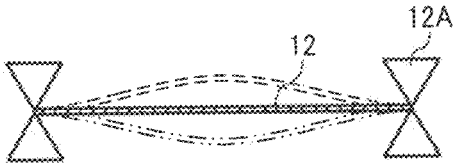

FIGS. 17A and 17B are schematic bottom and cross-sectional views, respectively, illustrating an exemplary embodiment of the thin film 12.

Figure 18:
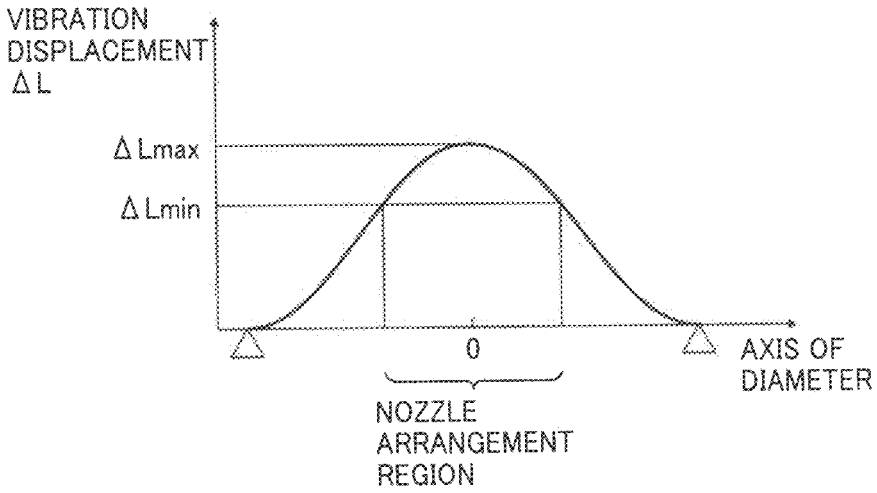
FIG. 18 is a cross-sectional view of the thin film illustrating the fundamental vibration mode.

When the thin film 12 is a simple circular film and a periphery 12A thereof is fixed, the thin film 12 may vibrate at a fundamental vibration mode as shown in FIG. 18. FIG. 18 is a cross-sectional view of the thin film 12 illustrating the fundamental vibration mode. The thin film 12 periodically vibrates in a vertical direction while the center O displaces at the maximum displacement (ΔLmax) and the periphery forms a node.

Figure 19:
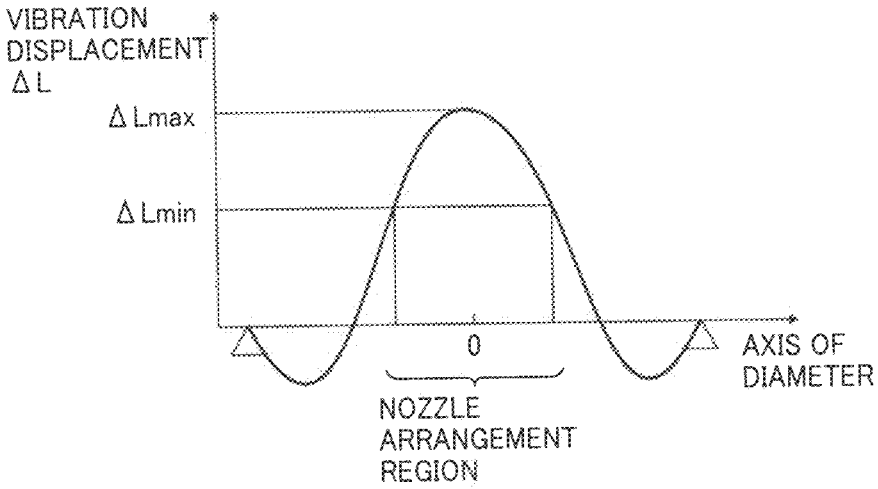
FIGS. 19 and 20 are cross-sectional views of the thin film illustrating higher vibration modes.
Figure 20:
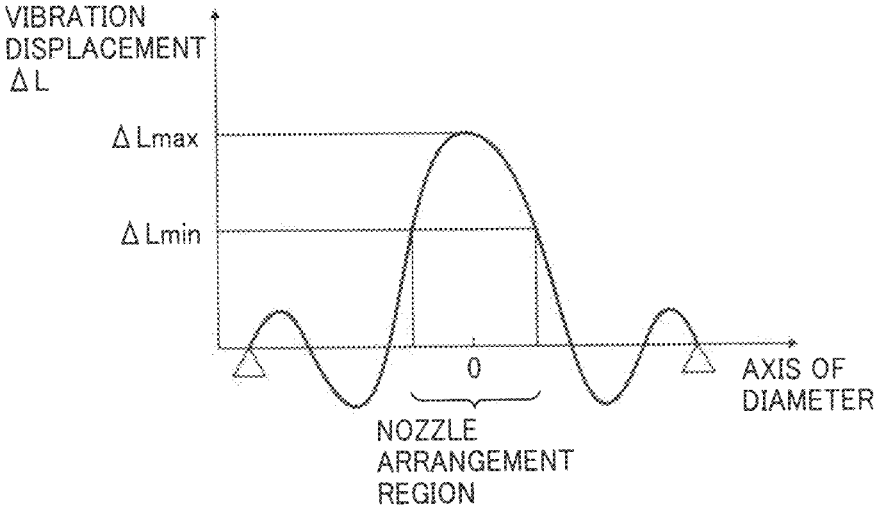

The thin film 12 may also vibrate at a higher mode as illustrated in FIGS. 19 and 20. In these cases, one or more nodes are concentrically formed within the thin film 12. The thin film 12 may axisymmetrically transform.

Figure 21:
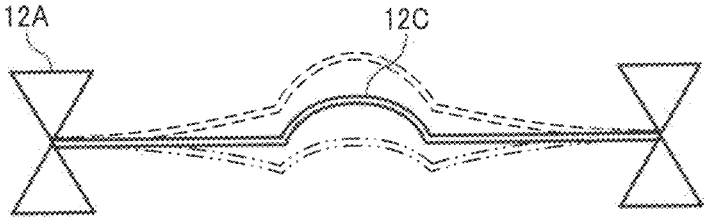
FIG. 21 is a schematic view illustrating another embodiment of the thin film.

The thin film 12 may be a thin film 12C having a convexity on the center portion thereof as illustrated in FIG. 21. In this case, a direction of movement of liquid droplets and the amount of amplitude can be more controllable.

When the circular thin film 12 vibrates, a sound pressure $P_{ac}$ generates in the toner components liquid 10 in the vicinity of the nozzles 11. The sound pressure $P_{ac}$ is proportional to a vibration rate $V_m$ of the thin film 12. It is known that the sound pressure $P_{ac}$ generates as a counter reaction of a radiation impedance $Z_r$ of a medium (i.e., the toner components liquid 10). The sound pressure $P_{ac}$ is defined by the following equation:

$$P_{ac}(r,t)=Z_r \cdot V_m(r,t) \quad (1)$$

The vibration rate $V_m$ is a function of time (t) because it periodically varies with time. Periodic variations such as sine waves and square waves may be formed. The vibration rate $V_m$ is also a function of position because the vibration displacement varies by location. Since the thin film 12 axisymmetrically vibrates, the vibration rate $V_m$ is substantially a function of coordinates of radius (r).

Upon generation of a sound pressure $P_{ac}$ that is proportional to the vibration rate $V_m$ of the thin film 12, the toner components liquid 10 is discharged to a gas phase according to periodical variation of the sound pressure $P_{ac}$.

The toner components liquid 10 periodically discharged to a gas phase are formed into spherical particles due to the difference in surface tension between the liquid phase and the gas phase. Thus, liquid droplets are periodically formed.

In order to reliably form liquid droplets, the vibration frequency of the thin film 12 is preferably from 20 kHZ to 2.0 MHz, and more preferably from 50 kHz to 500 kHz. When the frequency is 20 kHz or more, particles of colorants and waxes may be finely dispersed in the toner components liquid 10.

When the amount of displacement of the sound pressure is 10 kPa or more, particles of colorants and waxes may be more finely dispersed in the toner components liquid 10.

The larger the vibration displacement near the nozzles 11 of the thin film 12, the larger the diameter of liquid droplets discharged from the nozzles 11. When the vibration displacement is too small, small liquid droplets or no liquid droplet may be formed. In order to reduce variations in size of liquid droplets, the nozzles 11 are preferably provided on appropriate positions.

Referring to FIGS. 18 to 20, the nozzles 11 are preferably provided on a region in which the ratio (ΔLmax/ΔLmin) of the maximum vibration displacement (ΔLmax) to the minimum vibration displacement (ΔLmin) is 2.0 or less. In this case, the size of liquid droplets may be uniform and the resultant toner can provide high quality images.

When the toner components liquid 10 has a viscosity of 20 mPa·s or less and a surface tension of from 20 to 75 mN/m, undesired small liquid droplets are produced in the same region. Therefore, the displacement amount of the sound pressure needs to be 500 kPa or less, and more preferably 100 kPa or less.

To reliably form extremely uniform-sized liquid droplets, the thin film 12 is preferably formed from a metal plate having a thickness of from 5 to 500 μm and the nozzles 11 preferably have an aperture diameter of from 1 to 40 μm, more preferably from 3 to 35 μm, for example. The aperture diameter represents the diameter when the nozzle 11 is a perfect circle, and the minor diameter when the nozzle 11 is an ellipse. The number of nozzles 11 is preferably from 2 to 3,000.

Figure 22:
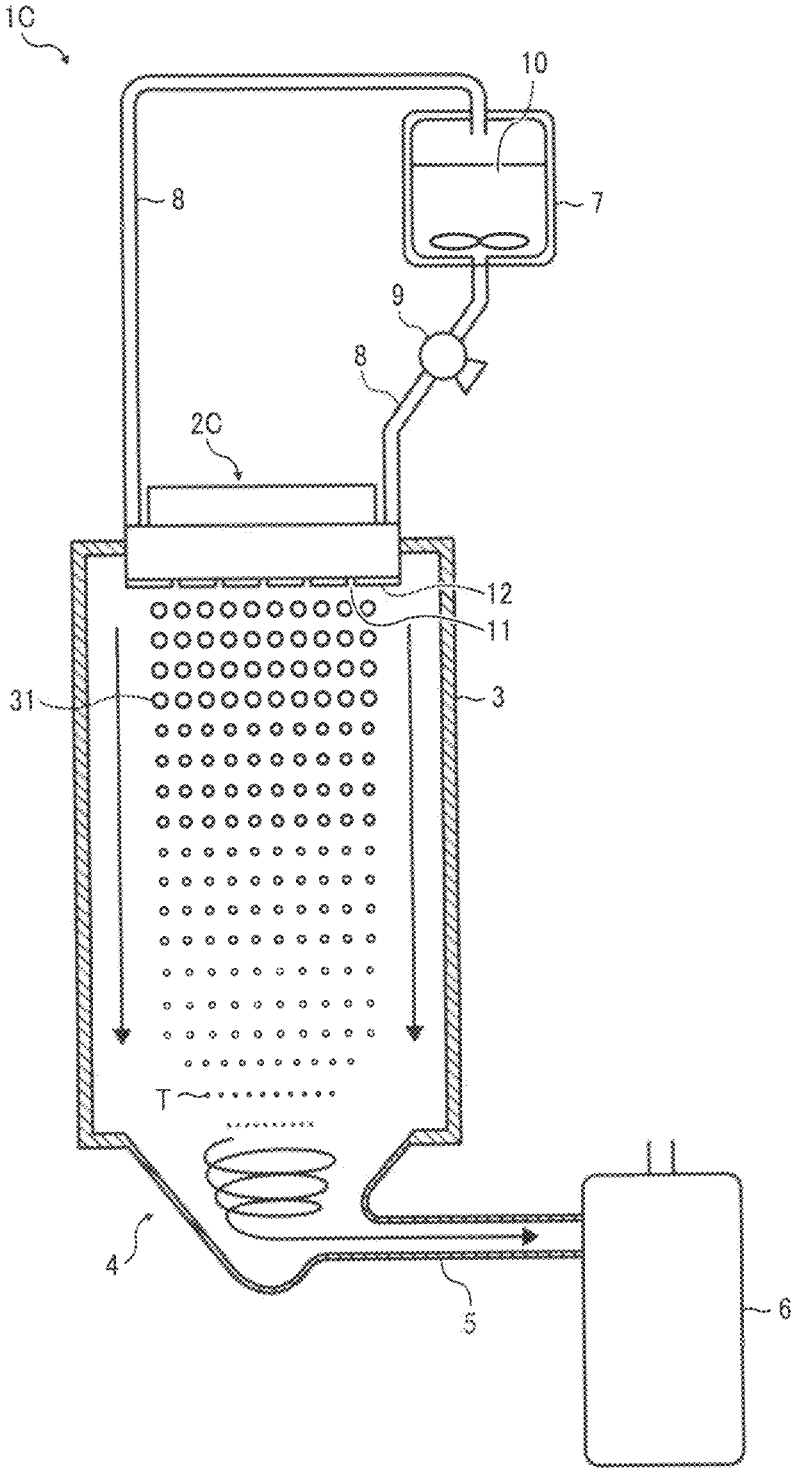
FIG. 22 is a schematic view illustrating another exemplary embodiment of a toner production apparatus employing a liquid resonance method.

FIG. 22 is a schematic view illustrating another exemplary embodiment of a toner production apparatus 1C employing a liquid resonance method. The toner production apparatus 1C forms liquid droplets by resonance of liquid, while the toner production apparatus 1A and 1B forms liquid droplets by vertical vibration of a thin film including multiple nozzles.

Accordingly, the toner production apparatus 1C includes a thin film having an appropriate strength so as not to vibrate. In the present embodiment, suitable materials for the thin film include silicon and silicon oxides, for example. The thin film is preferably formed from a silicon substrate or a SOI (i.e., silicon on insulator) substrate, in view of forming nozzles thereon. When the thin film is relatively thick, nozzles preferably have a two-step cross section, to improve discharging performance.

Figure 23:
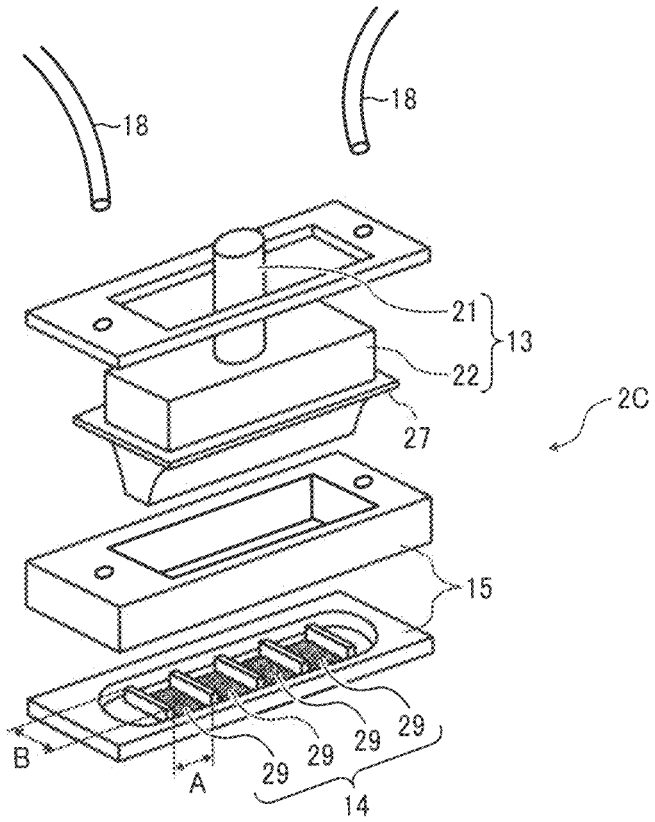
FIG. 23 is an exploded view of an embodiment of the liquid droplet injection unit illustrated in FIG. 22.
Figure 24:
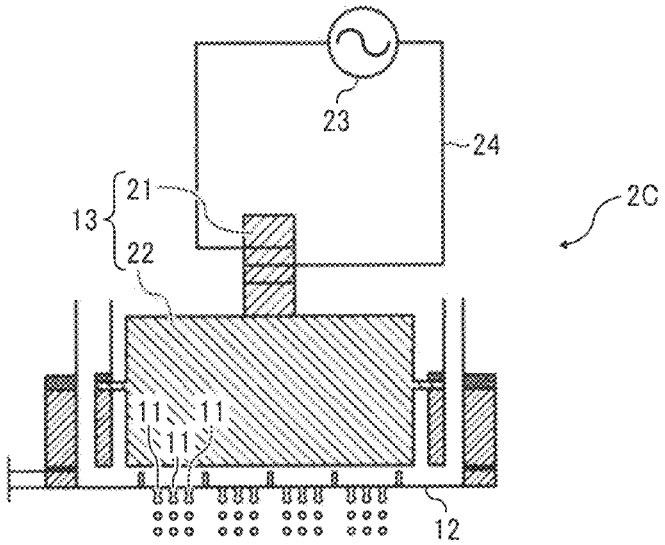
FIG. 24 is a schematic cross-sectional view illustrating an embodiment of the liquid droplet injection unit illustrated in FIG. 22.
Figure 25:
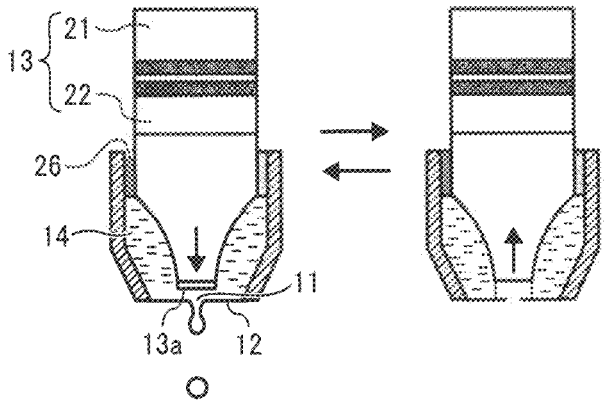
FIG. 25 is a schematic view of an example of formation of liquid droplets in the liquid droplet injection unit illustrated in FIG. 22.

FIG. 23 is an exploded view of an embodiment of the liquid droplet injection unit 2C. FIG. 24 is a schematic cross-sectional view illustrating an embodiment of the liquid droplet injection unit 2C. FIG. 25 is a schematic view of an example of formation of liquid droplets in the liquid droplet injection unit 2C.

Referring to FIGS. 23 to 25, the liquid droplet injection unit 2C includes a thin film 12, a vibration unit 13, and a flow path member 15. The thin film 12 includes multiple nozzles 11. The flow path member 15 forms a retention part 14 that is configured to retain the toner components liquid 10 comprising a resin and a colorant. The vibration unit 13 and a wall of the retention part 14 are preferably separated by a vibration separating member 26. Alternatively, the vibration unit 13 may be directly fixed to a wall by a node portion 27 of the vibration unit 13. The node portion 27 vibrates at a small vibration amplitude. The toner components liquid 10 is supplied to the retention part 14 through a liquid supplying tube 18.

Exemplary embodiments of the vibration unit 13 and the vibration amplifying unit 22 include the above-described embodiments for the toner production apparatuses 1A and 1B.

Walls of the retention part 14 may be made of materials which do not dissolve in or denaturalize the toner components liquid 10, such as metals, ceramics, and plastics, for example. The retention part 14 is divided into multiple retention regions 29 by multiple walls, so that vibration of several ten kHz is evenly applied to each retention regions 29 and resonance frequency is increased.

Referring to FIG. 25, when a vibration of a vibrating surface 13*a* that is generated by the vibration unit 13 is transmitted to the toner components liquid 10 in the retention part 14, liquid resonance occurs in the toner components liquid 10. The toner components liquid 10 is reliably discharged from the multiple nozzles 11 provided on the thin film 12 upon application of even pressure, without deposition of dispersoids in the toner components liquid 10 on the thin film 12.

Figure 26A:
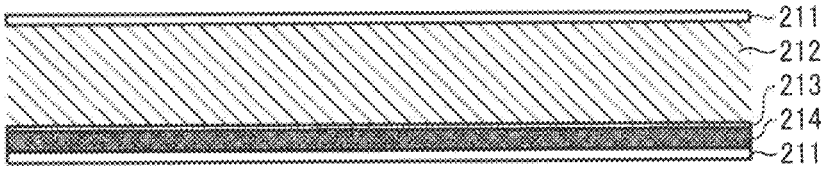
FIGS. 26A to 26D are schematic views illustrating an exemplary method of forming nozzles having a two-step cross section.
Figure 26B:
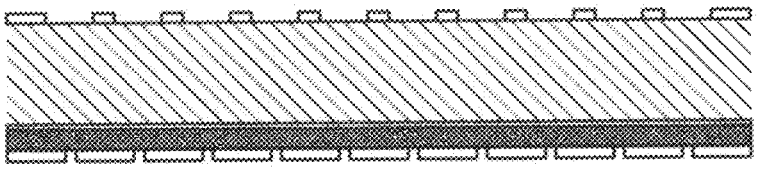
Figure 26C:
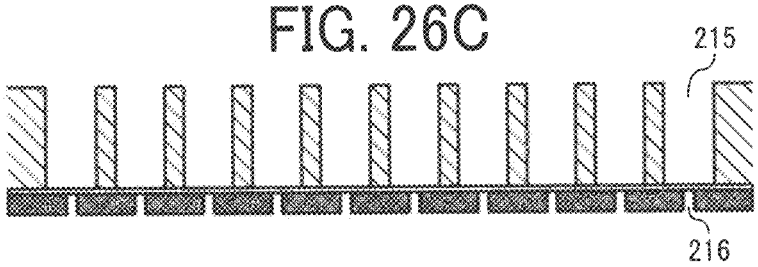
Figure 26D:
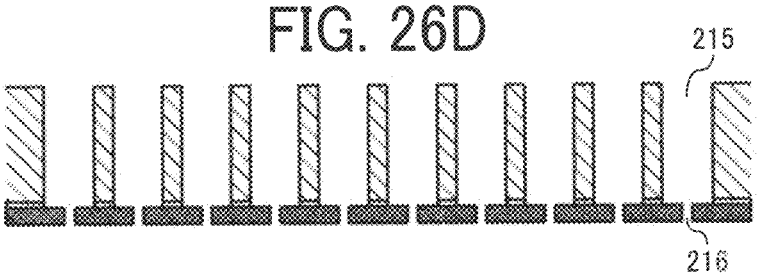

FIGS. 26A to 26D are schematic views illustrating an exemplary method of forming nozzles having a two-step cross section. First, as illustrated in FIG. 26A, both sides of a silicon substrate are coated with a resist 211. Next, as illustrated in FIG. 26B, the silicon substrate is covered with photomasks including nozzle patterns and exposed to ultraviolet ray, to form nozzle patterns on the resists 211. Next, as illustrated in FIG. 26C, a support layer 212 side of the silicon substrate is subjected to anisotropic etching using ICP electrical discharge so that first nozzles 215 are formed. Subsequently, an active layer 214 side of the silicon substrate is subjected to anisotropic etching so that second nozzles 216 are formed. Finally, as illustrated in FIG. 26D, a dielectric layer 213 is removed by a hydrofluoric etching liquid to form two-step nozzles. Suitable silicon substrates include SOI substrates and single-layer silicon substrates. The depths of the first and second nozzles can be controlled by controlling the etching time.

To reliably form extremely uniform-sized liquid droplets, in the present embodiment, the thin film 12 preferably has a thickness of from 30 to 1,000 μm and the nozzles 11 preferably have an aperture diameter of from 4 to 15 μm, for example. The aperture diameter represents the diameter when the nozzle 11 is a perfect circle, and the minor diameter when the nozzle 11 is an ellipse.

Exemplary embodiments of the vibration unit 13 include multi-layer PZT and a combination of an ultrasonic vibrator and an ultrasonic horn, for example, which are capable of applying mechanical ultrasonic vibration with a large amplitude to the toner components liquid 10.

A vibration generated by the vibration unit 13 is transmitted to the toner components liquid 10 in the retention part 14, and liquid resonance occurs in the toner components liquid 10 in the retention part 14. The toner components liquid 10 is evenly discharged from the multiple nozzles 11 provided on the thin film 12 upon application of even pressure due to the liquid resonance, without deposition of dispersoids in the toner components liquid 10 on the thin film 12.

In a case in which the thin film 12 including the multiple nozzles 11 is mechanically vibrated, there may be a disadvantage that the multiple nozzles 11 vibrate unevenly, especially when the thin film 12 has a large area. As a result, the discharged liquid droplets may have a wide size distribution. By comparison, in a case in which the toner components liquid 10 is discharged due to liquid resonance, the discharged liquid droplets may have a narrow size distribution because pressure is evenly applied to each nozzles 11.

The liquid droplets are subjected to a drying process to remove the solvents from the liquid droplets. For example, the liquid droplets may be released into a gas such as heated dried nitrogen gas. The liquid droplets may be further subjected to a secondary drying process such as fluidized bed drying and vacuum drying, if desired.

In an exemplary toner of the present invention, the particle diameter distribution that is the ratio of the weight average particle diameter to the number average particle diameter of the toner is between 1.00 and 1.15, and the weight average particle diameter of the release agent in the liquid droplets is between 1% and 30% of the aperture diameter of the nozzle. (The weight average particle diameter of the release agent in the liquid droplets is substantially the same as that in the toner.) Such a toner may be produced by an exemplary method of the present invention as follows. For example, first, a binder resin such as a styrene-acrylic resin, a polyester resin, a polyol resin, or an epoxy resin is dissolved in an organic solvent, and a colorant, a release agent, and a graft polymer serving as a dispersion stabilizer are dispersed therein. The resultant toner components liquid is formed into liquid droplets and dried into solid toner particles by the above-described method. Alternatively, first, toner components are melted and kneaded, and the kneaded toner components are dissolved or dispersed in a solvent. The resultant toner components liquid is formed into liquid droplets and dried into solid toner particles by the above-described method. A toner including a release agent and a graft polymer generally exhibits good hot offset resistance while preventing nozzle clogging. This is because the release agent is finely dispersed in the toner without aggregating owing to the presence of the graft polymer.

Toner components include a resin and a colorant, and optionally include a release agent, a graft polymer, a charge controlling agent, a magnetic material, a fluidizer, a lubricant, a cleaning auxiliary agent, a resistance adjuster, etc.

These toner components are dissolved or dispersed in a solvent to prepare a toner components liquid. The toner components liquid is discharged from nozzles to form liquid droplets.

The solvent is preferably an organic solvent having a boiling point less than 150° C., because it is easy to remove. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Suitable organic solvents preferably have a solubility parameter of from 8 to 9.8 $(cal/cm^3)^{1/2}$, more preferably from 8.5 to 9.5 $(cal/cm^3)^{1/2}$ because polyester resins may have good solubility in such organic solvents. Ester solvents and ketone solvents are preferable because these solvents have large interactions with modified groups of release agents and effectively prevent crystal growth of release agents. From the viewpoint of ease of removal, ethyl acetate and methyl ethyl ketone are preferable.

Specific examples of suitable resins include, but are not limited to, homopolymers and copolymers of vinyl monomers such as styrene monomers, acrylic monomers, and methacrylic monomers, polyester resins, polyol resins, phenol resins, silicone resins, polyurethane resins, polyamide resins, furan resins, epoxy resins, xylene resins, terpene resins, coumarone-indene resins, polycarbonate resins, and petroleum resins.

Specific examples of the styrene monomers include, but are not limited to, styrenes such as styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene, and derivatives thereof.

Specific examples of the acrylic monomers include, but are not limited to, acrylic acids and esters thereof (i.e., acrylates) such as acrylic acid, methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of the methacrylic monomers include, but are not limited to, methacrylic acids and esters thereof (i.e., methacrylates) such as methacrylic acid, methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

Specific examples of other vinyl monomers include, but are not limited to, the following compounds:

(1) monoolefins such as ethylene, propylene, butylene, and isobutylene;

(2) polyenes such as butadiene and isoprene;

(3) halogenated vinyl compounds such as vinyl chloride, vinylidene chloride, vinyl bromide, and vinyl fluoride;

(4) vinyl esters such as vinyl acetate, vinyl propionate, and vinyl benzoate;
(5) vinyl ethers such as vinyl methyl ether, vinyl ethyl ether, and vinyl isobutyl ether;
(6) vinyl ketones such as vinyl methyl ketone, vinyl hexyl ketone, and methyl isopropenyl ketone;
(7) N-vinyl compounds such as N-vinylpyrrole, N-vinylcarbazole, N-vinylindole, and N-vinylpyrrolidone;
(8) vinylnaphthalenes;
(9) derivatives of acrylic acid or methacrylic acid such as acrylonitrile, methacrylonitrile, and acrylamide;
(10) unsaturated dibasic acids such as maleic acid, citraconic acid, itaconic acid, alkenyl succinic acid, fumaric acid, and mesaconic acid;
(11) unsaturated dibasic acid anhydrides such as maleic acid anhydride, citraconic acid anhydride, itaconic acid anhydride, and alkenyl succinic acid anhydride;
(12) unsaturated dibasic acid monoesters such as monomethyl maleate, monoethyl maleate, monobutyl maleate, monomethyl citraconate, monoethyl citraconate, monobutyl citraconate, monomethyl itaconate, monomethyl alkenyl succinate, monomethyl fumarate, and monomethyl mesaconate;
(13) unsaturated dibasic acid esters such as dimethyl maleate and dimethyl fumarate;
(14) α,β-unsaturated acids such as crotonic acid and cinnamic acid;
(15) α,β-unsaturated acid anhydrides such as crotonic acid anhydride and cinnamic acid anhydride;
(16) monomers having a carboxyl group such as anhydrides of α,β-unsaturated acids with lower fatty acids, anhydrides and monoesters of alkenyl malonic acid, alkenyl glutaric acid, and alkenyl adipic acid;
(17) hydroxyalkyl acrylates and methacrylates such as 2-hydroxyethyl acrylate, 2-hydroxyethyl methacrylate, and 2-hydroxypropyl methacrylate; and
(18) monomers having a hydroxyl group such as 4-(1-hydroxy-1-methylbutyl)styrene and 4-(1-hydroxy-1-methylhexyl)styrene.

The vinyl homopolymers and copolymers of the vinyl monomers may have a cross-linked structure formed using a cross-linking agent having 2 or more vinyl groups. Specific examples of the cross-linking agents having 2 or more vinyl groups include, but are not limited to, aromatic divinyl compounds such as divinylbenzene and divinylnaphthalene; diacrylate or dimethacrylate compounds in which acrylates or methacrylates are bound together with an alkyl chain (e.g., ethylene glycol diacrylate or dimethacrylate, 1,3-butylene glycol diacrylate or dimethacrylate, 1,4-butanediol diacrylate or dimethacrylate, 1,5-pentanediol diacrylate or dimethacrylate, 1,6-hexanediol diacrylate or dimethacrylate, neopentyl glycol diacrylate or dimethacrylate); diacrylate or dimethacrylate compounds in which acrylates or methacrylates are bound together with an alkyl chain having an ether bond (e.g., diethylene glycol diacrylate or dimethacrylate, triethylene glycol diacrylate or dimethacrylate, tetraethylene glycol diacrylate or dimethacrylate, polyethylene glycol #400 diacrylate or dimethacrylate, polyethylene glycol #600 diacrylate or dimethacrylate, dipropylene glycol diacrylate or dimethacrylate); diacrylate or dimethacrylate compounds in which acrylates or methacrylates are bound together with a chain having an aromatic group and an ether bond; and polyester diacrylate compounds such as MANDA (from Nippon Kayaku Co., Ltd.).

Specific examples of usable polyfunctional cross-linking agents include, but are not limited to, pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, triacyl cyanurate, and triallyl trimellitate.

The amount of the cross-linking agent is preferably 0.01 to 10 parts by weight based on 100 parts by weight of the monomer. In view of imparting good fixability and hot offset resistance to the resultant toner, aromatic divinyl compounds (particularly divinylbenzene) and diacrylate compounds in which acrylates are bound together with a chain having an aromatic group and an ether bond are preferable. Among the above monomers, combinations of monomers which can produce styrene copolymers or styrene-acrylic copolymers are preferable.

Specific examples of usable polymerization initiators for the polymerization of vinyl polymers and copolymers include, but are not limited to, 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobis isobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetylacetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, di-cumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropylperoxy dicarbonate, di-2-ethylhexylperoxy dicarbonate, di-n-propylperoxy dicarbonate, di-2-ethoxyethylperoxy carbonate, di-ethoxyisopropylperoxy dicarbonate, di(3-methyl-3-methoxybutyl)peroxy carbonate, acetylcyclohexylsulfonyl peroxide, tert-butylperoxy acetate, tert-butylperoxy isobutylate, tert-butylperoxy-2-ethylhexanoate, tert-butylperoxy laurate, tert-butyloxy benzoate, tert-butylperoxy isopropyl carbonate, di-tert-butylperoxy isophthalate, tert-butylperoxy allyl carbonate, isoamylperoxy-2-ethylhexanoate, di-tert-butylperoxy hexahydroterephthalate, and tert-butylperoxy azelate.

When the binder resin is a styrene-acrylic resin, THF-soluble components of the styrene-acrylic resin preferably has a molecular weight distribution such that at least one peak is present in both a number average molecular weight range of from 3,000 to 50,000 and that of 100,000 or more, determined by GPC. In this case, the resultant toner has good fixability, offset resistance, and storage stability. A binder resin including THF-soluble components having a molecular weight of 100,000 or less in an amount of from 50 to 90% is preferable. A binder resin having a molecular weight distribution such that a main peak is present in a molecular weight range of from 5,000 to 30,000 is more preferable. A binder resin having a molecular weight distribution such that a main peak is present in a molecular weight range of from 5,000 to 20,000 is much more preferable.

When the binder resin is a vinyl polymer such as a styrene-acrylic resin, the resin preferably has an acid value of from 0.1 to 100 mgKOH/g, more preferably from 0.1 to 70 mgKOH/g, and much more preferably from 0.1 to 50 mgKOH/g.

Specific examples of alcohol monomers for preparing usable polyester resins include, but are not limited to, diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols prepared by polymerizing bisphenol A with a cyclic ether such as ethylene oxide and propylene oxide.

In order that the polyester resin has a cross-linked structure, polyols having 3 or more valences are preferably used. Specific examples of the polyols having 3 or more valences include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxybenzene.

Specific examples of acid monomers for preparing usable polyester resins include, but are not limited to, benzene dicarboxylic acids (e.g., phthalic acid, isophthalic acid, terephthalic acid) and anhydrides thereof; alkyl dicarboxylic acids (e.g., succinic acid, adipic acid, sebacic acid, azelaic acid) and anhydrides thereof; unsaturated dibasic acids (e.g., maleic acid, citraconic acid, itaconic acid, alkenylsuccinic acid, fumaric acid, mesaconic acid); and unsaturated dibasic acid anhydrides (e.g., maleic acid anhydride, citraconic acid anhydride, itaconic acid anhydride, alkenylsuccinic acid anhydride).

Polycarboxylic acids having 3 or more valences can also be used. Specific examples of the polycarboxylic acids having 3 or more valences include, but are not limited to, trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid, and anhydrides and partial lower alkyl esters thereof.

When the binder resin is a polyester resin, THF-soluble components of the polyester resin preferably have a molecular weight distribution such that at least one peak is present in a number average molecular weight range of from 3,000 to 50,000, determined by GPC. In this case, the resultant toner has good fixability and offset resistance. A binder resin including THF-soluble components having a molecular weight of 100,000 or less in an amount of from 60 to 100% is preferable. A binder resin having a molecular weight distribution such that at least one peak is present in a molecular weight range of from 5,000 to 20,000 is more preferable.

When the binder resin is a polyester resin, the resin preferably has an acid value of from 0.1 to 100 mgKOH/g, more preferably from 0.1 to 70 mgKOH/g, and much more preferably from 0.1 to 50 mgKOH/g.

As described above, the molecular weight distribution of binder resins can be measured by gel permeation chromatography (GPC) using THF as a solvent.

The above-described vinyl polymer and/or polyester resin may include a monomer unit capable of reacting with both the vinyl polymer and the polyester resin. Specific examples of polyester monomers capable of reacting with the vinyl polymer include, but are not limited to, unsaturated dicarboxylic acids (e.g., phthalic acid, maleic acid, citraconic acid, itaconic acid) and anhydrides thereof. Specific examples of vinyl monomer capable of reacting with the polyester resin include, but are not limited to, monomers having carboxyl group or hydroxy group, acrylates, and methacrylates.

When the binder resin includes the polyester resin and the vinyl polymer in combination with another resin, the binder resin preferably includes resins having an acid value of from 0.1 to 50 mgKOH/g in an amount of not less than 60%.

The acid value of a binder resin of toner is determined by the following method according to JIS K-0070.

(1) In order to prepare a sample, toner components other than the binder resin are previously removed from the toner, and 0.5 to 2.0 g of the pulverized sample is precisely weighed. Alternatively, if the toner is directly used as a sample, the acid value and weight of the toner components other than the binder resin (such as a colorant and a magnetic material) are previously measured, and then the acid value of the binder resin is calculated.

(2) The sample is dissolved in 150 ml of a mixture of toluene and ethanol, mixing at a volume ratio of 4/1, in a 300 ml beaker.

(3) The mixture prepared above and the blank each are titrated with a 0.1 mol/l ethanol solution of KOH using a potentiometric titrator.

(4) The acid value of the sample is calculated from the following equation (2):

$$AV=[(S-B)\times f\times 5.61]/W \quad (2)$$

wherein AV (mgKOH/g) represents an acid value, S (ml) represents the amount of the ethanol solution of KOH used for the titration of the sample, B (ml) represents the amount of the ethanol solution of KOH used for the titration of the blank, f represents the factor of KOH, and W (g) represents the weight of the binder resin included in the sample.

Each of the binder resin and the toner including the binder resin preferably has a glass transition temperature (Tg) of from 35 to 80° C., and more preferably from 40 to 75° C., from the viewpoint of improving storage stability of the toner. When the Tg is too small, the toner is likely to deteriorate under high temperature atmosphere and cause offset when fixed. When the Tg is too large, fixability of the toner may deteriorate.

(Colorant)

Specific examples of usable colorants include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

These colorants can be combined with a resin to be used as a master batch. Specific examples of usable resins for the master batch include, but are not limited to, polyester-based resins, styrene polymers and substituted styrene polymers (e.g., polystyrenes, poly-p-chlorostyrenes, polyvinyltoluenes), styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, and paraffin waxes. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The toner preferably includes the master batch in an amount of from 0.1 to 20 parts by weight based on 100 parts by weight of the binder resin.

The resin used for the master batch preferably has an acid value of 30 mgKOH/g or less and an amine value of from 1 to 100, and more preferably an acid value of 20 mgKOH/g or less and an amine value of from 10 to 50. When the acid value is too large, chargeability of the toner may deteriorate under high humidity conditions and dispersibility of the colorant may deteriorate. When the amine value is too small or large, dispersibility of the colorant may deteriorate. The acid value and the amine vale can be measured according to JIS K-0070 and JIS K-7237, respectively.

A colorant dispersing agent can be used in combination with the colorant. The colorant dispersing agent preferably has high compatibility with the binder resin in order to well disperse the colorant. Specific examples of useable commercially available colorant dispersing agents include, but are not limited to, AJISPER® PB-821 and PB-822 (from Ajinomoto-Fine-Techno Co., Inc.), DISPERBYK®-2001 (from BYK-Chemie Gmbh), and EFKA® 4010 (from EFKA Additives BV).

The colorant dispersing agent preferably has a weight average molecular weight, which is a local maximum value of the main peak observed in the molecular weight distribution measured by GPC (gel permeation chromatography) and converted from the molecular weight of styrene, of from 500 to 100,000, more preferably from 3,000 from 100,000, from the viewpoint of enhancing dispersibility of the colorant. In particular, the average molecular weight is preferably from 5,000 to 50,000, and more preferably from 5,000 to 30,000. When the average molecular weight is too small, the dispersing agent has a high polarity, and therefore dispersibility of the colorant may deteriorate. When the average molecular weight is too large, the dispersing agent has a high affinity for the solvent, and therefore dispersibility of the colorant may deteriorate.

The toner preferably includes the colorant dispersing agent in an amount of from 1 to 50 parts by weight, and more preferably from 5 to 30 parts by weight, based on 100 parts by weight of the colorant. When the amount is too small, the colorant may not be sufficiently dispersed. When the amount is too large, chargeability of the resultant toner may deteriorate.

(Release Agent)

The toner may include a wax as a release agent to prevent the occurrence of offset when fixed.

Specific examples of usable waxes include, but are not limited to, aliphatic hydrocarbon waxes (e.g., low-molecular-weight polyethylene, low-molecular-weight polypropylene, polyolefin wax, microcrystalline wax, paraffin wax, SASOL wax), oxides of aliphatic hydrocarbon waxes (e.g., polyethylene oxide wax) and copolymers thereof, plant waxes (e.g., candelilla wax, carnauba wax, haze wax, jojoba wax), animal waxes (e.g., bees wax, lanoline, spermaceti wax), mineral waxes (e.g., ozokerite, ceresin, petrolatum), waxes including fatty acid esters (e.g., montanic acid ester wax, castor wax) as main components, and partially or completely deacidified fatty acid esters (e.g., deacidified carnauba wax).

In addition, the following compounds can also be used: saturated straight-chain fatty acids (e.g., palmitic acid, stearic acid, montanic acid, and other straight-chain alkyl carboxylic acid), unsaturated fatty acids (e.g., brassidic acid, eleostearic acid, parinaric acid), saturated alcohols (e.g., stearyl alcohol, eicosyl alcohol, behenyl alcohol, carnaubyl alcohol, ceryl alcohol, melissyl alcohol, and other long-chain alkyl alcohol), polyols (e.g., sorbitol), fatty acid amides (e.g., linoleic acid amide, olefin acid amide, lauric acid amide), saturated fatty acid bisamides (e.g., methylenebis capric acid amide, ethylenebis lauric acid amide, hexamethylenebis stearic acid amide), unsaturated fatty acid amides (e.g., ethylenebis oleic acid amide, hexamethylenebis oleic acid amide, N,N'-dioleyl adipic acid amide, N,N'-dioleyl sebacic acid amide), aromatic biamides (e.g., m-xylenebis stearic acid amide, N,N-distearyl isophthalic acid amide), metal salts of fatty acids (e.g., calcium stearate, calcium laurate, zinc stearate, magnesium stearate), aliphatic hydrocarbon waxes to which a vinyl monomer such as styrene and an acrylic acid is grafted, partial ester compounds of a fatty acid (such as behenic acid monoglyceride) with a polyol, and methyl ester compounds having a hydroxyl group obtained by hydrogenating plant fats.

More specifically, the following compounds are preferable: a polyolefin obtained by radical polymerizing an olefin under high pressure; a polyolefin obtained by purifying low-molecular-weight by-products of a polymerization reaction of a high-molecular-weight polyolefin; a polyolefin polymerized under low pressure in the presence of a Ziegler catalyst or a metallocene catalyst; a polyolefin polymerized using radiation, electromagnetic wave, or light; a low-molecular-weight polyolefin obtained by thermally decomposing a high-molecular-weight polyolefin; paraffin wax; microcrystalline wax; Fischer-Tropsch wax; synthesized hydrocarbon waxes synthesized by Synthol method, Hydrocaol method, or Arge method; synthesized waxes including a compound having one carbon atom as a monomer unit; hydrocarbon waxes having a functional group such as hydroxyl group and carboxyl group; mixtures of a hydrocarbon wax and a hydrocarbon wax having a functional group; and these waxes to which a vinyl monomer such as styrene, a maleate, an acrylate, a methacrylate, and a maleic anhydride is grafted.

Among these waxes, carnauba wax, synthesized ester wax, and paraffin wax are most preferable in view of preventing the occurrence of offset.

In addition, these waxes subjected to a press sweating method, a solvent method, a recrystallization method, a vacuum distillation method, a supercritical gas extraction method, or a solution crystallization method, so as to more narrow the molecular weight distribution thereof are preferable. Further, low-molecular-weight solid fatty acids, low-molecular-weight solid alcohols, low-molecular-weight solid compounds, and other compounds from which impurities are removed are preferable.

The wax preferably has a melting point of from 60 to 140° C., and more preferably from 60 to 120° C., so that the resultant toner has a good balance of toner blocking resistance and offset resistance. When the melting point is too small, toner blocking resistance may deteriorate. When the melting point is too large, offset resistance may deteriorate.

When two or more waxes are used in combination, functions of both plasticizing and releasing may simultaneously appear. As a wax having a function of plasticizing, for example, a wax having a low melting point, a wax having a branched structure, and a wax having a polar group can be used. As a wax having a function of releasing, for example, a wax having a high melting point, a wax having a straight-chain structure, and a nonpolar wax having no functional group can be used. For example, a combination of two waxes having a difference in melting point of from 10 to 100° C., and a combination of a polyolefin and a grafted polyolefin are preferable.

When two waxes having a similar structure are used in combination, a wax having relatively lower melting point exerts a function of plasticizing and the other wax having a relatively higher lower melting point exerts a function of releasing. When the difference in melting point between the two waxes is from 10 to 100° C., these functions are separately expressed efficiently. When the difference is too small, these functions are not separately expressed efficiently. When the difference is too large, each of the functions is unlikely to be enhanced by their interaction. It is preferable that one wax has a melting point of from 60 to 120° C., more preferably from 60 to 100° C.

As mentioned above, a wax having a branched structure, a wax having a polar group such as a functional group, and a wax modified with a component different from the main component of the wax relatively exerts a function of plasticizing. On the other hand, a wax having a straight-chain structure, a nonpolar wax having no functional group, and an unmodified wax relatively exerts a function of releasing. Specific preferred examples of suitable combinations of waxes include, but are not limited to, a combination of a polyethylene homopolymer or copolymer including ethylene as a main component, and a polyolefin homopolymer or copolymer including an olefin other than ethylene as a main component; a combination of a polyolefin and a graft-modified polyolefin; a combination of a hydrocarbon wax and one member selected from an alcohol wax, a fatty acid wax, and an ester wax, and; a combination of a Fischer-Tropsch wax or a polyolefin wax, and a paraffin wax or a microcrystalline wax; a combination of a Fischer-Tropsch wax and a polyolefin wax; a combination of a paraffin wax and a microcrystalline wax; and a combination of a hydrocarbon wax and one member selected from a carnauba wax, a candelilla wax, a rice wax, and a montan wax.

The toner preferably has a maximum endothermic peak in a temperature range of from 60 to 110° C. of the endothermic curve measured by DSC (differential scanning calorimetry). In this case, the toner has a good balance of preservability and fixability.

The toner preferably includes the wax in an amount of from 0.2 to 20 parts by weight, more preferably from 0.5 to 10 parts by weight, based on 100 parts by weight of the binder resin.

In the present invention, the melting point of a wax is defined as a temperature in which the maximum endothermic peak is observed in an endothermic curve measured by DSC.

As a DSC measurement instrument, a high-precision inner-heat power-compensation differential scanning calorimeter is preferable. The measurement is performed according to ASTM D3418-82. The endothermic curve is obtained by heating a sample at a temperature increasing rate of 10° C./min, after once heated and cooled the sample.

(Graft Polymer)

Release agents are preferably used in combination with graft polymers. A suitable graft polymer may be formed from a polyolefin resin and a vinyl resin, for example.

Such a graft polymer formed from a polyolefin resin and a vinyl resin has a structure such that the vinyl resin is grafted to the polyolefin resin. The vinyl resin may be a homopolymer or copolymer of a vinyl monomer, for example.

In the toner, the release agent is partially incorporated into or adhered to the graft polymer.

The graft polymer prevents fine particles of the release agent from migrating and re-aggregating in the toner components liquid. This is because the polyolefin resin part of the graft polymer has a high affinity for the release agent, while the vinyl resin part of the graft polymer has a high affinity for the binder resin, resulting in generating dispersing effect of the release agent.

Figure 27:
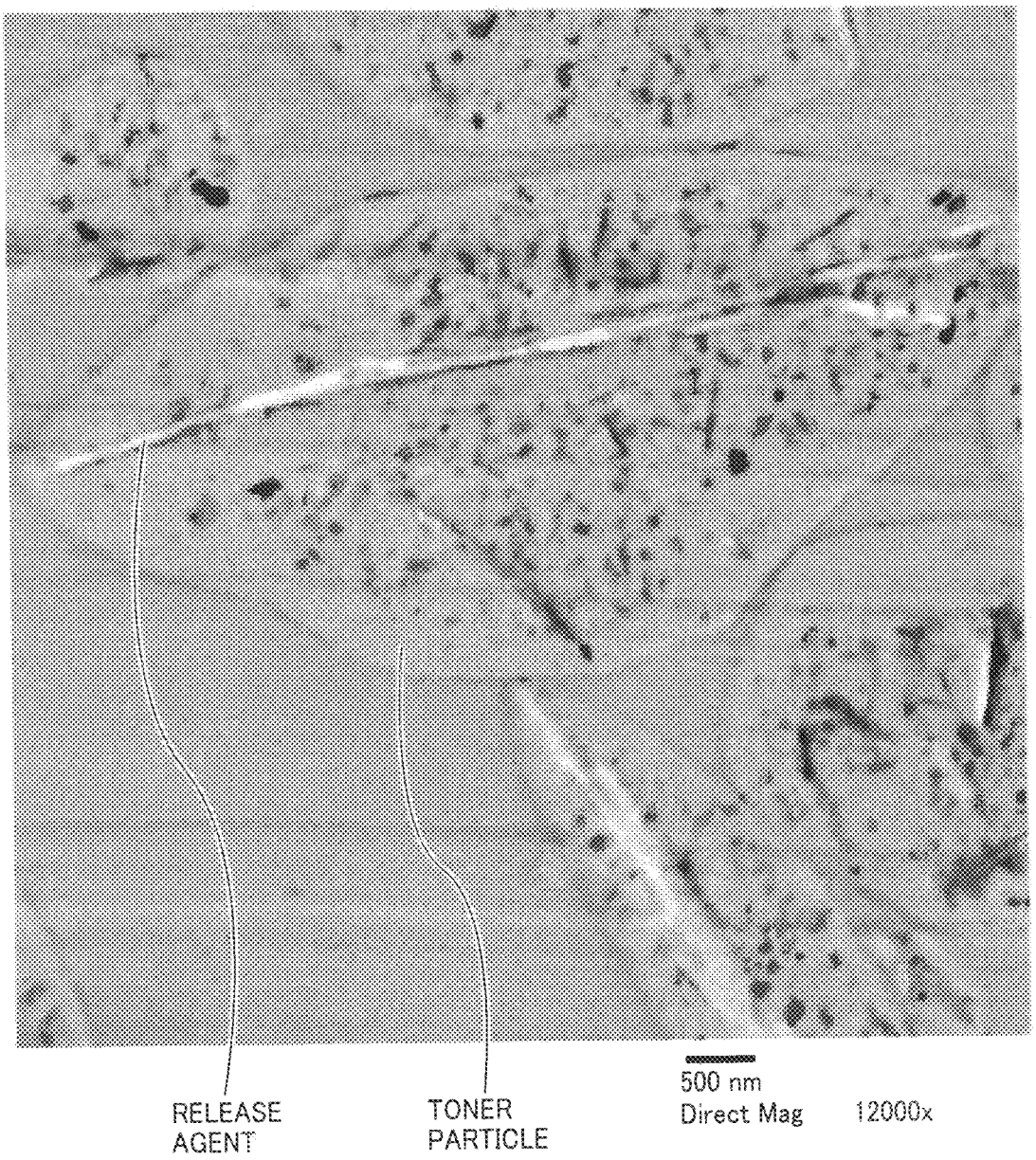
FIG. 27 is a cross-sectional image of an exemplary toner particle obtained using TEM (transmission electron microscope)

The weight average particle diameter of the release agent in liquid droplets of the toner components liquid is preferably from 1 to 30%, more preferably from 3 to 20% of the aperture diameter of nozzles. When the release agent is too smaller than the aperture diameter, it means that the release agent is excessively dispersed in the toner, and therefore the toner is unlikely to exhibit offset resistance. When the release agent is too larger than the aperture diameter, the release agent may cause nozzle clogging. Even if the release agent passes through the nozzles, a release agent particle may extend over the resultant toner particle, as shown in a cross-sectional image of a toner particle obtained using TEM (transmission electron microscope) illustrated in FIG. 27, resulting in a wide particle diameter distribution of the resultant toner particles. In addition, release agent particles which project out from toner particles, may disadvantageously from thin film of the release agent or and deteriorates fluidity of the toner, when used for one-component developing methods. The particle diameter of release agents in the toner may be controlled by varying dispersing conditions of beads mill such as the diameter of beads, revolution, and dispersing time. It may be also controlled by adjusting the amount of the graft polymer.

Specific examples of the olefins composing the polyolefin resin include, but are not limited to, ethylene, propylene, 1-butene, isobutylene, 1-hexene, 1-dodecene, and 1-octadecene.

The polyolefin resin may be a polymer of an olefin (hereinafter referred to as olefin polymer), an oxide of an olefin polymer, a modified olefin polymer, and a copolymer of an olefin with another monomer capable of copolymerizing with the olefin, for example.

Specific examples of usable olefin polymers include, but are not limited to, polyethylene, polypropylene, ethylene/propylene copolymer, ethylene/1-butene copolymer, and propylene/1-hexene copolymer.

Specific examples of usable oxides of olefin polymers include, but are not limited to, oxides of polymers of the above-mentioned olefins.

Specific examples of usable modified olefin polymers include, but are not limited to, maleic acid derivative adducts of polymers of the above-mentioned olefins. Specific examples of the maleic acid derivative include, but are not limited to, maleic anhydride, monomethyl maleate, monobutyl maleate, and dimethyl maleate.

Thermally degraded olefin polymer can also be preferably used. The thermally degraded olefin polymer is a polyolefin resin obtained by thermally degraded a polyolefin resin (such as polyethylene and polypropylene) having a weight average molecular weight of from 50,000 to 5,000,000 at a temperature of from 250 to 450° C. The resultant thermally degraded polyolefin resin preferably includes double bonds in an amount of from 30 to 70% per one molecule, which is calculated from the number average molecular weight thereof.

Specific examples of the copolymers of an olefin with another monomer capable of copolymerizing with the olefin include, but are not limited to, copolymers of an unsaturated carboxylic acid or an alkyl ester thereof with an olefin. Specific examples of the unsaturated carboxylic acids include, but are not limited to, (meth)acrylic acid, itaconic acid, and maleic anhydride. Specific examples of the alkyl esters of the unsaturated carboxylic acid include, but are not limited to, alkyl esters of a (meth)acrylic acid having 1 to 18 carbon atoms, and alkyl esters of maleic acid having 1 to 18 carbon atoms.

The polyolefin resin does not need to be formed from an olefin monomer, so long as the resultant polymer (i.e., the polyolefin resin) has a polyolefin structure. Therefore, a polymethylene such as SASOL wax, for example, can be used as a monomer for preparing the polyolefin resin.

Among the above polyolefin resins, olefin polymers, thermally degraded olefin polymers, oxides of olefin polymers, and modified olefin polymers are preferable; polyethylene, polymethylene, polypropylene, and ethylene/propylene copolymer and thermally degraded compounds thereof, oxidized polyethylene, oxidized polypropylene, and maleinated polypropylene are more preferable; and thermally degraded polyethylene and polypropylene are much more preferable.

The polyolefin resin typically has a softening point of from 60 to 170° C., and preferably from 70 to 150° C. When the softening point is too high, fluidity of the resultant toner may increase. When the softening point is too low, the resultant toner may have good separating ability.

The polyolefin resin typically has a number average molecular weight of from 500 to 20,000 and a weight average molecular weight of from 800 to 100,000, preferably a number average molecular weight of from 1,000 to 15,000 and a weight average molecular weight of from 1,500 to 60,000, and more preferably a number average molecular weight of from 1,500 to 10,000 and a weight average molecular weight of from 2,000 to 30,000, from the viewpoint of preventing formation of undesired toner film on the carrier and enhancing separating ability of the resultant toner.

The vinyl monomer that is grafted to the polyolefin resin may be a homopolymer or copolymer of a vinyl monomer, for example.

Specific examples of the vinyl monomers include, but are not limited to, styrene monomers (e.g., styrene, α-methylstyrene, p-methylstyrene, m-methylstyrene, p-methoxystyrene, p-hydroxystyrene, p-acetoxystyrene, vinyltoluene, ethylstyrene, phenylstyrene, benzylstyrene), alkyl esters of unsaturated carboxylic acids having 1 to 18 carbon atoms (e.g., methyl(meth)acrylate, ethyl(meth)acrylate, butyl(meth)acrylate, and 2-ethylhexyl(meth)acrylate), vinyl ester monomers (e.g., vinyl acetate), vinyl ether monomers (e.g., vinyl methyl ether), vinyl monomers containing a halogen atom (e.g., vinyl chloride), diene monomers (e.g., butadiene, isobutylene), and unsaturated nitrile monomers (e.g., (meth)acrylonitrile, cyanostyrene). These can be used alone or in combination.

Among these, styrene monomers, alkyl esters of unsaturated carboxylic acids, (meth)acrylonitrile, and combinations thereof are preferable; and styrene, and a combination of styrene and an alkyl ester of (meth)acrylic acid or (meth) acrylonitrile are more preferable.

The vinyl resin preferably has an SP (i.e., solubility parameter) value of from 10.0 to 11.5 $(cal/cm^3)^{1/2}$. The SP value of the vinyl resin is controlled considering that of the binder resin. The SP value can be calculated by Fedors method.

The vinyl resin typically has a number average molecular weight of from 1,500 to 100,000 and a weight average molecular weight of from 5,000 to 200,000, preferably a number average molecular weight of from 2,500 to 50,000 and a weight average molecular weight of from 6,000 to 100,000, and more preferably a number average molecular weight of from 2,800 to 20,000 and a weight average molecular weight of from 7,000 to 50,000.

The vinyl resin typically has a glass transition temperature (Tg) of from 40 to 90° C., preferably from 45 to 80° C., and more preferably from 50 to 70° C. When the Tg is 40° C. or more, preservability of the resultant toner improves. When the Tg is 90° C. or less, low-temperature fixability of the resultant toner improves.

The graft polymer has a structure such that a vinyl resin is grafted to a polyolefin resin, and prepared by the following method, for example. First, a polyolefin resin, which forms a main chain of the resultant graft polymer, is dissolved in an organic solvent. A vinyl monomer, which forms a branched chain of a grafted vinyl resin, is further dissolved in the organic solvent. The polyolefin resin and the vinyl monomer are subjected to a graft polymerization in the organic solvent in the presence of a polymerization initiator such as an organic peroxide. The weight ratio of the polyolefin resin to the vinyl monomer is preferably from 1/99 to 30/70, and more preferably from 2/98 to 27/83, from the viewpoint of preventing the occurrence of filming problem.

The graft polymer may include unreacted polyolefin resin and vinyl resin which is not grafted. However, the unreacted polyolefin resin and the vinyl resin which is not grafted need not to be removed, and such a graft polymer is rather preferable as a mixed resin.

The mixed resin preferably includes the unreacted polyolefin resin in an amount of 5% or less by weight, and more preferably 3% by weight or less, and the vinyl resin which is not grafted in an amount of 10% by weight or less, and more preferably 5% by weight or less. The mixed resin preferably includes the graft polymer in an amount of 85% by weight or more, and more preferably 90% by weight or more.

The ratio of the graft polymer in the mixed resin, the molecular weights of the graft polymer and the vinyl resin, etc., can be varied by controlling the composition of raw materials, the reaction temperature, the reaction time, etc.

Specific examples of suitable graft polymers include, but are not limited to, graft polymers including the following combinations of (A) a polyolefin resin unit and (B) a vinyl resin unit.

(1) (A) oxidized polypropylene and (B) styrene/acrylonitrile copolymer;

(2) (A) polyethylene/polypropylene mixture and (B) styrene/acrylonitrile copolymer;

(3) (A) ethylene/propylene copolymer and (B) styrene/acrylic acid/butyl acrylate copolymer (4) (A) polypropylene and (B) styrene/acrylonitrile/butyl acrylate/monobutyl maleate copolymer;

(5) (A) maleinated polypropylene and (B) styrene/acrylonitrile/acrylic acid/butyl acrylate copolymer;

(6) (A) maleinated polypropylene and (B) styrene/acrylonitrile/acrylic acid/2-ethylhexyl acrylate copolymer; and (7) (A) polyethylene/maleinated polypropylene mixture and (B) acrylonitrile/butyl acrylate/styrene/monobutyl maleate copolymer.

The graft polymer can be prepared as follows, for example. First, a wax such as a polyolefin resin is dissolved or dispersed in a solvent such as toluene and xylene. The mixture is heated to a temperature of from 100 to 200° C., and a vinyl monomer and a peroxide polymerization initiator are added to the mixture. After termination of polymerization, the solvent is removed.

Specific examples of usable peroxide initiator include, but are not limited to, benzoyl peroxide, di-tert-butyl peroxide, tert-butyl peroxide benzoate, and di-tert-butyl peroxihexahydrophthalate.

The amount of the peroxide initiator is typically from 0.2 to 10% by weight, and preferably from 0.5 to 5% by weight, based on total weight of raw materials.

As mentioned above, the graft polymer may include unreacted polyolefin resin and vinyl resin which is not grafted. The unmodified polyolefin resin and vinyl resin which is not grafted need not to be removed, and such a graft polymer is rather preferable as a mixed resin.

The graft polymer typically includes the polyolefin resin unit in an amount of from 1 to 90% by weight, and preferably from 5 to 80% by weight. The graft polymer typically includes the vinyl resin unit in an amount of from 10 to 99% by weight, and preferably from 20 to 95% by weight.

The toner typically includes the graft polymer, including unreacted polyolefin resin and vinyl resin which is not grafted, in an amount of from 5 to 300 parts by weight, and preferably from 10 to 150 parts by weight, based on 100 parts by weight of the release agent, from the viewpoint of stably dispersing the release agent.

(Charge Controlling Agent)

The toner may optionally include a charge controlling agent. Specific examples of usable charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has a large charge quantity, and thereby increasing electrostatic attracting force between a developing roller and the toner, resulting in deterioration of fluidity of the toner and image density of the resultant images.

The charge controlling agent and the release agent can be melt-kneaded with the master batch or the binder resin, or directly added to the organic solvent.

(Fluidity Improving Agent)

The toner may include a fluidity improving agent that enables the resultant toner to easily fluidize. Fluidity improving agents are added to the surfaces of toner particles.

Specific examples of usable fluidity improving agents include, but are not limited to, fine powders of fluorocarbon resins such as vinylidene fluoride and polytetrafluoroethylene; fine powders of silica prepared by a wet process or a dry process, titanium oxide, and alumina; and these silica, titanium oxide, and alumina surface-treated with a silane-coupling agent, a titanium-coupling agent, or a silicone oil. Among these, fine powders of silica, titanium oxide, and alumina are preferable, and silica surface-treated with a silane-coupling agent or a silicone oil is more preferable.

The fluidity improving agent preferably has an average primary particle diameter of from 0.001 to 2 μm, and more preferably from 0.002 to 0.2 μm.

A fine powder of silica is prepared by a vapor phase oxidization of a halogenated silicon compound, and typically called a dry process silica or a fumed silica.

Specific examples of useable commercially available fine powders of silica prepared by a vapor phase oxidization of a halogenated silicon compound include, but are not limited to, AEROSIL® 130, 300, 380, TT600, MOX170, MOX80, and COK84 (from Nippon Aerosil Co., Ltd.), CAB-O-SIL® M-5, MS-7, MS-75, HS-5, and EH-5 (from Cabot Corporation), WACKER HDK® N20, V15, N20E, T30, and T40 (from Wacker Chemie Gmbh), Dow Corning® Fine Silica (from Dow Corning Corporation), and FRANSIL (from Fransol Co.).

A hydrophobized fine powder of silica prepared by a vapor phase oxidization of a halogenated silicon compound is more preferable. The hydrophobized silica preferably has a hydrophobized degree of from 30 to 80%, measured by a methanol titration test. The hydrophobic property is imparted to a silica when an organic silicon compound is reacted with or physically adhered to the silica. A hydrophobizing method in which a fine powder of silica prepared by a vapor phase oxidization of a halogenated silicon compound is treated with an organic silicon compound is preferable.

Specific examples of the organic silicon compounds include, but are not limited to, hydroxypropyltrimethoxysilane, phenyltrimethoxysilane, n-hexadecyltrimethoxysilane, n-octadecyltrimethoxysilane, vinyltrimethoxysilane, vinyltriethoxysilane, vinyltriacetoxysilane, dimethylvinylchlorosilane, divinylchlorosilane, γ-methacryloxypropyltrimethoxysilane, hexamethyldisilazane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units per molecule and 0 to 1 hydroxyl group bound to Si in the terminal siloxane units, and silicone oils such as dimethyl silicone oil. These can be used alone or in combination.

The fluidity improving agent preferably has a number average particle diameter of from 5 to 100 nm, and more preferably from 5 to 50 nm.

The fluidity improving agent preferably has a specific surface area of 30 $m^2/g$ or more, and more preferably from 60 to 400 $m^2/g$, measured by nitrogen adsorption BET method.

The surface-treated fluidity improving agent preferably has a specific surface area of 20 $m^2/g$ or more, and more preferably from 40 to 300 $m^2/g$, measured by nitrogen adsorption BET method.

(Cleanability Improving Agent)

A cleanability improving agent is added to the toner so as to effectively remove toner particles remaining on the surface of a photoreceptor or a primary transfer medium after a toner image is transferred onto a recording medium. Specific examples of usable cleanability improving agents include, but are not limited to, fatty acids and metal salts thereof such as zinc stearate and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

The fluidity improving agent and the cleanability improving agent are fixed on the surface of toner particles. Therefore, these agents are generally called external additives. Suitable mixers for mixing the toner particles and the external additive include known mixers for mixing powders. Specific examples of the mixers include V-form mixers, locking mixers, Loedge Mixers, NAUTER MIXERS, HENSCHEL MIXERS and the like mixers. When fixing the external additive on the surface of the mother toner particles, HYBRIDIZER, MECHANOFUSION, Q-TYPE MIXER, etc. can be used.

Figure 28:
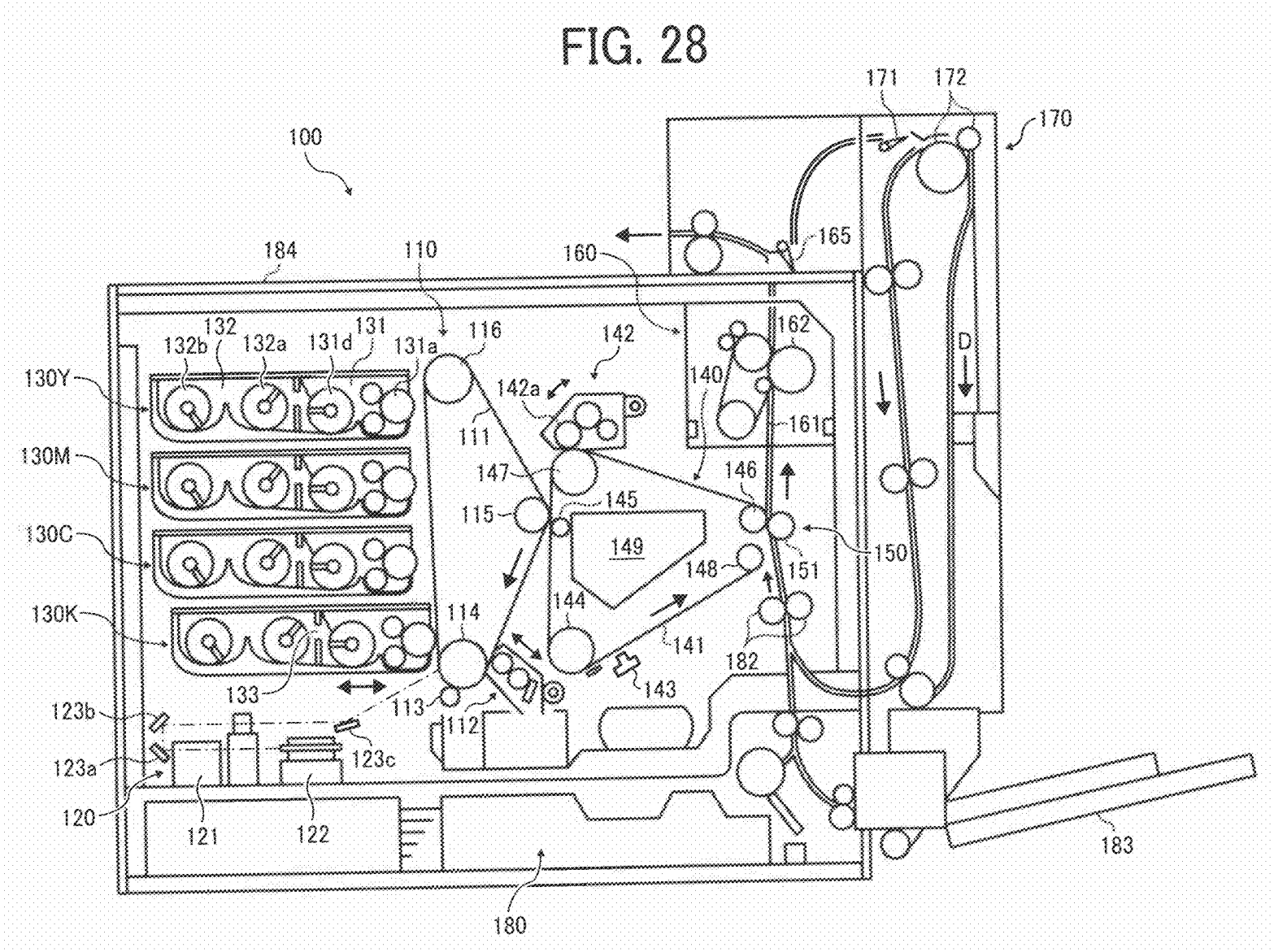
FIG. 28 is a schematic view illustrating an exemplary embodiment of an image forming apparatus.

FIG. 28 is a schematic view illustrating an exemplary embodiment of an image forming apparatus 100.

An image forming apparatus 100 includes a photoreceptor unit 110, a writing optical unit 120, developing devices 130K, 130C, 130M and 130Y, an intermediate transfer unit 140, a secondary transfer unit 150, a fixing unit 160, and a duplex printing paper reversing unit 170. A black toner image, a cyan toner image, a magenta toner image, and a yellow toner image are formed one by one on a photoreceptor belt 111 of the photoreceptor unit 110, and the toner images are finally superimposed on one another to produce a composite full-color image. Around the photoreceptor belt 111, a photoreceptor cleaning device 112, a charging roller 113, the developing devices 130Y, 130M, 130C and 130K, and an intermediate transfer belt 141 of the intermediate transfer unit 140 are provided. The photoreceptor belt 111 is stretched taut by a driving roller 114, a primary transfer facing roller 115, and a stretching roller 116, and is rotated by a driving motor. The writing optical unit 120 converts color image data into optical signals and performs optical writing based on color information so that an electrostatic latent image is formed on the photoreceptor belt 111. The writing optical unit 120 includes a semiconductor laser 121 serving as a light source, a polygon mirror 122, and reflective mirrors 123*a*, 123*b*, and 123*c*.

A black developing device 130K containing a black toner, a cyan developing device 130C containing a cyan toner, a magenta developing device 130M containing a magenta toner, and a yellow developing device 130Y containing a yellow toner, are arranged in the image forming apparatus 100 in order from the bottom thereof. Further, an attach/detach mechanism, not shown, configured to move each of the developing devices 130K, 130C, 130M, and 130Y toward or away from the photoreceptor belt 111 is provided in the image forming apparatus 100.

The toner contained in each of the developing devices 130 (symbols K, C, M and Y representing each of the colors are omitted) is charged to a predetermined polarity. A developing bias is applied to a developing sleeve 131*a* from a developing bias electric source. Therefore, the developing sleeve 131*a* is biased to a predetermined potential against the photoreceptor belt 111. When an electromagnetic clutch, which is configured to transmit a driving force from a motor to the developing device 130, is turned on, the attach/detach mechanism moves the developing device 130 toward the photoreceptor belt 111 because the driving force is transmitted from the motor. When developing an electrostatic latent image, one of the developing devices 130 moves so as to contact the photoreceptor belt 111. By comparison, when the electromagnetic clutch is turned off, the developing device 130 moves away from the photoreceptor belt 111 because the driving force is not transmitted from the motor.

When the image forming apparatus 100 is on standby, the developing devices 130K, 130C, 130M and 130Y are set apart from the photoreceptor belt 111. When an image forming operation starts, the photoreceptor belt 111 is exposed to a laser light beam based on color image data so that an electrostatic latent image is formed thereon. The developing sleeve 131*a* of the black developing device 130K starts rotating before an entry of a leading end of a black electrostatic latent image into a black developing area so that the black electrostatic latent image is developed with a black toner. Such a developing operation is continued in the black developing area. At a time a rear end of the black electrostatic latent image passes through the black developing area, the black developing device 130K moves away from the photoreceptor belt 111. The developing device of a next color moves and contacts the photoreceptor belt 111 to prepare for a next developing operation, before an entry of a leading end of an electrostatic latent image of the next color into a developing area for developing the next color image.

The intermediate transfer unit 140 includes the intermediate transfer belt 141, a belt cleaning device 142, and a position detector 143. The intermediate transfer belt 141 is stretched taut by a driving roller 144, a primary transfer roller 145, a secondary transfer facing roller 146, a cleaning facing roller 147, and a tension roller 148, and is rotated by a driving motor, not shown. Multiple position detection marks are formed on end portions of the intermediate transfer belt 141 at which images are not formed. At a time one of these marks is detected by the position detector 143, an image forming operation starts. The belt cleaning device 142 includes a cleaning brush 142*a* and an attach/detach mechanism, not shown, configured to move the cleaning device 142. While transferring each color toner images onto the intermediate transfer belt 141, the cleaning brush 142*a* moves away from the intermediate transfer belt 141 by the attach/detach mechanism.

The secondary transfer unit 150 includes a secondary transfer roller 151 and an attach/detach mechanism, not shown, equipped with a clutch configured to move the secondary transfer roller 151 toward and away from the intermediate transfer belt 141. The secondary transfer roller 151 oscillates around the rotation center of the attach/detach mechanism in synchronization of an entry of a transfer paper into a transfer area. The transfer paper contacts the intermediate transfer belt 141 by application of a predetermined pressure from the secondary transfer roller 151 and the secondary transfer facing roller 146. The secondary transfer roller 151 is accurately provided in parallel with the secondary transfer facing roller 146 by a position decision member, not shown, provided in the intermediate transfer unit 140. A contact pressure of the secondary transfer roller 151 with the intermediate transfer belt 141 is kept constant by a position decision roller bearing, not shown, provided on the secondary transfer roller 151. When the secondary transfer roller 151 contacts the intermediate transfer belt 141, a transfer bias having an opposite polarity to the toner is applied to the secondary transfer roller 151, and then the composite toner image (hereinafter simply "toner image") is transferred onto the transfer paper.

On the other hand, when the image forming operation starts, the transfer paper is fed from a transfer paper cassette 180 or a manual feed tray 183, and is stopped at a nip formed by a pair of registration rollers 182. The registration rollers 182 starts driving in synchronization with an entry of a leading end of the toner image formed on the intermediate transfer belt 141 into a secondary transfer area that is formed between the secondary transfer roller 151 and the intermediate transfer belt 141. As a result, positions of the transfer paper and the toner image are aligned. The toner image formed on the intermediate transfer belt 141 is superimposed on the transfer paper, and then the transfer paper passes the secondary transfer area. The transfer paper is charged by a transfer bias applied from the secondary transfer roller 151, and therefore almost all the toner image is transferred onto the transfer paper. The transfer paper having the toner image thereon is then fed to the fixing unit 160. The toner image is melted and fixed on the transfer paper at a nip formed between a pressing roller 162 and a fixing belt 161 controlled to a predetermined temperature. The transfer paper is discharged from the main body of the image forming apparatus, and stacked on a discharging tray 184 face down. Thus, a full color copy is obtained.

When a duplex printing is performed, the transfer paper is fed to the duplex printing paper reversing unit 170 by a duplex printing switch pick 165 after passing through the fixing unit 160. In the duplex printing paper reversing unit 170, the transfer paper is guided in a direction indicated by an arrow D by the reversing switch pick 171. After a rear end of the transfer paper passes through the reversing switch pick 171, a pair of reversing rollers 172 stops rotating to stop the transfer paper. The pair of reversing rollers 172 starts rotating in the reverse direction after a pause for a predetermined time so that the transfer paper starts switchback. At that time, the reversing switch pick 171 switches so that the transfer paper is fed to the pair of registration rollers 182. The reversed transfer paper is stopped at a nip formed between the registration rollers 182. The pair of registration rollers 182 is then timely driven to feed the transfer paper to the secondary transfer area, so that a toner image is transferred onto the other side of the transfer paper from the intermediate transfer belt 141. After the toner image is melted and fixed in the fixing unit 160, the transfer paper is discharged from the main body of the image forming apparatus.

On the other hand, the surface of the photoreceptor belt 111 is cleaned by the photoreceptor cleaning device 112 after toner images are transferred onto the intermediate transfer belt 141. The surface of the photoreceptor belt 111 may be uniformly neutralized using a neutralization lamp so as to be cleaned more easily. After transferring the toner image onto the transfer paper, the surface of the intermediate transfer belt 141 is cleaned by thrusting the cleaning brush 142*a* of the belt cleaning device 142 thereto using the attach/detach mechanism. Toner particles removed from the intermediate transfer belt 141 are accumulated in a waste toner tank 149.

Figure 29:
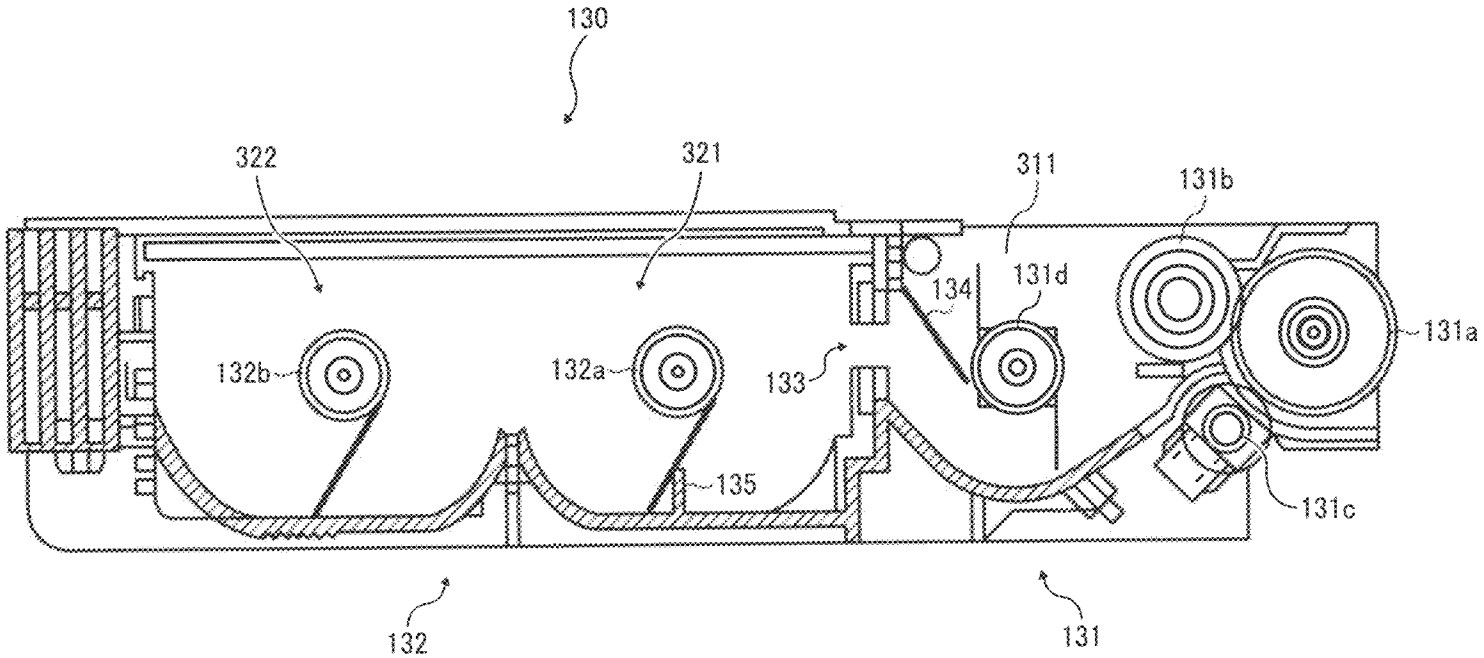
FIG. 29 is a schematic view illustrating an embodiment of a developing device.

FIG. 29 is a schematic view illustrating an embodiment of the developing device 130.

The developing device 130 includes a developing unit 131 and a toner cartridge 132. The developing unit 131 is configured to develop an electrostatic image formed on the photoreceptor belt 111 with a toner serving as a developer. The toner cartridge 132 is configured to supply a toner to the developing unit 131.

The developing unit 131 faces the photoreceptor belt 111 and forms a developing area therebetween. The developing unit 131 includes a developing sleeve 131*a*, a toner supply roller 131*b*, a toner layer thickness control roller 131*c*, and a first transport paddle 131*d*. The developing sleeve 131*a* is configured to transport the toner to the developing area. The toner supply roller 131*b* is configured to supply the toner to the developing sleeve 131*a*. The toner layer thickness control roller 131*c* is configured to control the thickness of a toner layer formed on the developing sleeve 131*a*. The first transport paddle 131*d* is configured to transport the toner.

The toner cartridge 132 includes a first toner storage chamber 321, a second toner storage chamber 322, a second transport paddle 132*a*, a third transport paddle 132*b*, and a rib 135. The first and second toner storage chambers 321 and 322 are configured to store a toner. The second and third transport paddles 132*a* and 132*b* are configured to transport the toner to the developing unit 131. The rib 135 is provided on an inner bottom surface of the first toner storage chamber 321 of the toner cartridge 132 at a portion in which the second transport paddle 132*a* rotates.

In the present embodiment, the toner is used as a one-component developer. One-component developers have an advantage over two-component developers in terms of replacement of toner. It is generally hard to separate toner particles from carrier particles in two-component developers so as to replace the toner particles with fresh toner particles. By comparison, it is easy to replace toner particles in one-component developers with fresh toner particles because one-component developers include no carrier particles. In the present embodiment, toner particles in the toner cartridge 132 are substantially the same as toner particles in the developing unit 131.

The one-component developer used for the developing device 130 is preferably a non-magnetic one-component developer. Generally, developability of magnetic one-component developers may be controlled by controlling magnetization that depends on the amount of magnetic materials included in the developer. On the other hand, developability of non-magnetic one-component developers may be controlled by controlling the amounts of external additives present of the surface of the developer because external additives generally influence chargeability and fluidity. Non-magnetic one-component developers can maintain good developability for an extended period of time in the developing device 130 of the present embodiment.

In the developing device 130, the developing unit 131 and the toner cartridge 132 are horizontally arranged in line. An opening 133 is provided between the developing unit 131 and the toner cartridge 132 to transport the toner therebetween. A control valve 134 is provided on the opening 133 on the side of the developing unit 131.

In the developing device 130, toner particles pass through the opening 133. Fresh toner particles of the same amount as toner particles consumed in the developing unit 131 are supplied from the toner cartridge 132 to the developing unit 131 through the opening 133. Toner particles which have deteriorated in the developing unit 131 are discharged from the developing unit 131 to the toner cartridge 132. The toner cartridge 132 can be replaced with a new one independently of the developing unit 131.

The toner is compressed by the toner supply roller 31*b* and the toner layer thickness control roller 31*c* in the developing unit 131. As a result, concavities and convexities on the surface of the toner are smoothened. However, the smoothened toner has a larger adhesive force to the photoreceptor belt 111. Therefore, when such a toner disadvantageously remains on the photoreceptor belt 111, it is more difficult to remove the toner from the surface of the photoreceptor belt 111, especially under low humidity conditions.

Additionally, the smoothened toner has higher transferability. However, the resultant images may have fog in background that is unlikely to be observed visually in general conditions. This is because external additives present on the surface of toner are buried in the toner upon application of pressure because the external additives are typically harder than the toner. As the amount of the external additives present on the surface of the toner decreases, chargeability of the toner changes. In particular, silica which is generally used as an external additive has high charge quantity because of having a large specific surface area. Therefore, as the amount of the silica present on the surface of the toner particles decreases, chargeability of the toner largely changes.

In addition, fluidity of the toner decreases as the external additives are buried in the toner. The fluidity represents adhesion force of the toner. For example, the external additive can decrease an adhesion force between the toner and the photoreceptor belt 111 by existing therebetween. Similarly, the external additive can decrease an adhesion force between the toner and the developing sleeve 131*a* by existing therebetween, resulting in improvement of developability of the toner. As the amount of the external additive present on the surface of the toner decreases, developability of the toner decreases.

In a typical non-magnetic one-component developing method, toner particles are supplied to a developing sleeve from a toner supply roller selectively and successively in order of particle diameter, from small to large (i.e., selective development). Therefore, deteriorated coarse toner particles may disadvantageously remain in a developing hopper unless fresh toner particles are supplied from a toner cartridge, which results in deterioration of the resultant images and the occurrence of toner scattering.

In the developing device 130, toner particles remaining in the developing unit 131 are at once returned and discharged to the toner cartridge 132 through the opening 133 so as to be mixed with fresh toner particles in the toner cartridge 132. As a result, mixed toner particles including a small amount of deteriorated toner particles are advantageously transported to the developing unit 131 again through the opening 133.

As described above, the developing device 130 includes the developing unit 131 including the developing sleeve 131*a* and the first transport paddle 131*d*, and the toner cartridge 132. The developing sleeve 131*a* is configured to rotate while bearing a toner so that an electrostatic latent image formed on the photoreceptor belt 111 is developed with the toner. The first transport paddle 131*d* is configured to draw up and agitate a toner. A reason why the developing device 130 is divided into 2 units is that the developing unit 131 has durability equivalent to several times that of the toner cartridge 132.

The first transport paddle 131*d* transports a toner to the toner supply roller 131*b* while agitating the toner. The toner supply roller 131*b* brings the toner into abrasive contact with the developing sleeve 131*a* so that the toner is frictionally charged. The charged toner is adsorbed to the developing sleeve 131*a* by mirror force, and the amount of toner to be transported to the developing area is controlled by the toner layer thickness control roller 131*c*. A thin toner layer formed on the developing sleeve 131*a* develops the electrostatic latent image on the photoreceptor belt 111 in the developing area upon application of a developing bias.

Since toner supply roller 131*b* brings the toner into abrasive contact with the developing sleeve 131*a*, concavities and convexities on the surface of the toner are smoothened by application of pressing force. The smoothened toner has a larger adhesion force. Additionally, because external additives present on the surface of the toner are buried by application of pressing force, fluidity deteriorates and charge quantity varies. As a result, developability, transferability, and cleanability of the toner deteriorate.

With increase of deteriorated toner particles in a developing hopper 311 and consumption of toner particles in the developing unit 131, fresh toner particles are supplied from the toner cartridge 132 to the developing unit 131 through the opening 133. The toner cartridge 132 includes the first and second toner storage chambers 321 and 322 including the second and third transport paddles 132*a* and 132*b*, respectively. The second and third transport paddles 132*a* and 132*b* each abrasively contact an inner wall of the toner cartridge 132. The second and third transport paddles 132*a* and 132*b* rotate so that fresh toner particles are supplied to the developing unit 131 through the opening 133.

Simultaneously, deteriorated toner particles are discharged from the developing unit 131 to the toner cartridge 132 through the opening 133. The deteriorated toner particles are mixed with fresh toner particles in the toner cartridge 132. External additives present on the surfaces of the fresh toner particles are redistributed to the surfaces of the deteriorated toner particles, while the deteriorated toner particles are discharged from the developing unit 131 to the first toner storage chamber 321, transported to the second toner storage chamber 322 by the second transport paddle 132*a*, and returned to the first toner storage chamber 321 by the third transport paddle 132*b*. As a result, chargeability and fluidity of the deteriorated toner particles substantially recover to the initial level.

The recovered toner particles are resupplied from the first toner storage chamber 321 to the developing unit 131. The recovered toner particles and fresh toner particles form a thin layer thereof on the developing sleeve 131*a* and produce high quality images for an extended period of time.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Graft Polymer

An autoclave reaction vessel equipped with a thermometer and a stirrer is charged with 480 parts of xylene and 100 parts of a low-molecular-weight polyethylene (SANWAX® LEL-400 from Sanyo Chemical Industries, Ltd., having a softening point of 128° C.). The atmosphere in the reaction vessel is substituted with nitrogen. A mixture liquid of 755 parts of styrene, 100 parts of acrylonitrile, 45 parts of butyl acrylate, 21 parts of acrylic acid, 36 parts of di-t-butyl peroxyhexahydroterephthalate, and 100 parts of xylene is dropped therein over a period of 3 hours at 170° C. so that the mixture is subjected to a polymerization. The mixture is further left for 0.5 hours at 170° C. The solvent (i.e., xylene) is removed therefrom.

Thus, a graft polymer having a number average molecular weight of 3,300, a weight average molecular weight of 18,000, a glass transition temperature of 65.0° C., and an SP value of the vinyl resin of 11.0 $(cal/cm^3)^{1/2}$ is prepared.

Preparation of Wax Dispersion 1

A container equipped with a stirrer and a thermometer is charged with 120 parts of a polyester resin (having a weight average molecular weight of 20,000), 40 parts of a carnauba wax, 40 parts of the graft polymer prepared above, and 800 parts of ethyl acetate. The mixture is heated to 85° C. and agitated for 20 minutes so that the polyester resin, the carnauba wax, and the graft polymer are dissolved in the ethyl acetate, followed by rapid cooling, so that fine particles of the carnauba wax are deposited. The resultant dispersion is subjected to a dispersion treatment using a bead mill (LABSTAR LMZ06 from Ashizawa Finetech Ltd.) under the following conditions.

Dispersion media: PSZ beads with a diameter of 0.3 mm
Filling factor of beads: 80%
Peripheral speed: 2,500 rpm (10 m/sec)
Liquid feeding speed: 300 ml/min
Dispersion time: 1 hour Thus, a wax dispersion W-1 is prepared. In the wax dispersion W-1, wax particles have a weight average particle diameter of 0.8 μm, which is 8% of the aperture diameter of nozzle of 10 μm.

Preparation of Wax Dispersion 2

The procedure for preparation of the wax dispersion W-1 is repeated except for changing the diameter of the PSZ beads to 0.1 mm. Thus, a wax dispersion W-2 is prepared. In the wax dispersion W-2, wax particles have a weight average particle diameter of 0.1 μm, which is 1% of the aperture diameter of nozzle of 10 μm.

Preparation of Wax Dispersion 3

The procedure for preparation of the wax dispersion W-1 is repeated except for changing the diameter of the PSZ beads to 0.5 mm. Thus, a wax dispersion W-3 is prepared. In the wax dispersion W-3, wax particles have a weight average particle diameter of 3.0 μm, which is 30% of the aperture diameter of nozzle of 10 μm.

Preparation of Wax Dispersion 4

The procedure for preparation of the wax dispersion W-1 is repeated except for changing the diameter of the PSZ beads to 0.1 mm, the filling factor of beads to 85%, and the peripheral speed to 3,000 rpm (12 m/sec). Thus, a wax dispersion W-4 is prepared. In the wax dispersion W-4, wax particles have a weight average particle diameter of 0.05 μm, which is 0.5% of the aperture diameter of nozzle of 10 μm.

Preparation of Wax Dispersion 5

The procedure for preparation of the wax dispersion W-1 is repeated except for changing the diameter of the PSZ beads to 0.5 mm and the filling factor of beads to 75%. Thus, a wax dispersion W-5 is prepared. In the wax dispersion W-5, wax particles have a weight average particle diameter of 3.5 μm, which is 35% of the aperture diameter of nozzle of 10 μm.

Preparation of Wax Dispersion 6

The procedure for preparation of the wax dispersion W-1 is repeated except for changing the diameter of the PSZ beads to 0.5 mm, the filling factor of beads to 75%, and the peripheral speed to 2,000 rpm (8 m/sec). Thus, a wax dispersion W-6 is prepared. In the wax dispersion W-6, wax particles have a weight average particle diameter of 5.0 μm, which is 50% of the aperture diameter of nozzle of 10 μm.

Properties of the wax dispersions prepared above are shown in Table 1.

TABLE 1

| Wax Dispersion | Dispersion Diameter (μm) | Dispersion Diameter/ Nozzle Aperture Diameter (%) |
|---|---|---|
| W-1 | 0.8 | 8 |
| W-2 | 0.1 | 1 |
| W-3 | 3.0 | 30 |
| W-4 | 0.05 | 0.5 |
| W-5 | 3.5 | 35 |
| W-6 | 5.0 | 50 |

Toner Example 1

Preparation of Colorant Dispersion

At first, 20 parts of a carbon black (REGAL® 400 from Cabot Corporation) and 2 parts of a colorant dispersing agent (AJISPER® PB-821 from Ajinomoto Fine-Techno Co., Inc.) are primarily dispersed in 78 parts of ethyl acetate using a mixer equipped with agitation blades. The resultant primary dispersion is subjected to a dispersing treatment using a DYNO-MILL so that the colorant (i.e., carbon black) is more finely dispersed and aggregations thereof are completely removed by application of strong shear force. The resultant secondary dispersion is filtered with a filter (made of PTFE) having 0.45 μm-sized fine pores. Thus, a colorant dispersion is prepared.

Preparation of Toner Components Liquid

At first, 15 parts of the colorant dispersion, 100 parts of a 20% (solid basis) ethyl acetate solution of the polyester resin (having a weight average molecular weight of 20,000) which is used for the wax dispersion, 30 parts of the wax dispersion W-1, and 150 parts of ethyl acetate are mixed using a mixer equipped with agitation blades. Thus, a toner components liquid is prepared.

Preparation of Toner

The toner components liquid is supplied to the liquid droplet injection unit 2B including a ring vibration unit of the toner production apparatus 1B illustrated in FIG. 11.

The thin film 12 is a nickel plate having an outer diameter of 8.0 mm and a thickness of 20 μm on which circular nozzles having a diameter of 10 μm are provided. The nozzles are formed by electroforming. The nozzles are formed within the central region having a substantially circular shape having a diameter of about 5 mm, so that the distance between each of the holes is 100 μm (like hound's-tooth check). The piezoelectric substance is a laminated lead zirconate titanate (PZT). The vibration frequency is 100 kHz.

The toner components liquid is discharged from the nozzles to form liquid droplets under the following conditions.

Flow rate of dried air: 2.0 L/min for nitrogen gas for dispersion, 30.0 L/min for inner dried nitrogen gas Inner temperature: 27 to 28° C.

Dew-point temperature: −20° C.

Vibration frequency: 98 kHz

The discharged liquid droplets are dried into solid mother toner particles. The mother toner particles are suction-collected using a filter having 1 μm-sized fine pores. The mother toner particles are then mixed with 2.0% of a hydrophobized silica (H2000 from Clariant Japan K. K.) using a HENSCHEL MIXER (from Mitsui Mining Co., Ltd.). Thus, a black toner (a) is prepared.

The toner (a) has a weight average particle diameter (D4) of 5.3 μm and a very narrow particle diameter distribution (D4/Dn) of 1.02. The toner (a) is continuously produced for 5 hours without causing nozzle clogging.

Toner Example 2

The toner components liquid prepared in Toner Example 1 is supplied to the liquid droplet injection unit 2A including a horn vibration unit of the toner production apparatus 1A illustrated in FIG. 1.

The thin film 12 is a nickel plate having an outer diameter of 8.0 mm and a thickness of 20 μm on which circular nozzles having a diameter of 10 μm are provided. The nozzles are formed by electroforming. The nozzles are formed within the central region having a substantially circular shape having a diameter of about 5 mm, so that the distance between each of the nozzles is 100 μm (like hound's-tooth check). The number of effective nozzles is about 1,000.

The toner components liquid is discharged from the nozzles to form liquid droplets under the following conditions.

Flow rate of dried air: 2.0 L/min for nitrogen gas for dispersion, 30.0 L/min for inner dried nitrogen gas Drying entrance temperature: 60° C.

Drying exit temperature: 45° C.

Dew-point temperature: −20° C.

Vibration frequency: 180 kHz

The discharged liquid droplets are dried into solid mother toner particles. The mother toner particles are suction-collected using a filter having 1 μm-sized fine pores. The mother toner particles are then mixed with 2.0% of a hydrophobized silica (H2000 from Clariant Japan K. K.) using a HENSCHEL MIXER (from Mitsui Mining Co., Ltd.). Thus, a black toner (b) is prepared.

The toner (b) has a weight average particle diameter (D4) of 5.3 μm and a very narrow particle diameter distribution (D4/Dn) of 1.02. The toner (b) is continuously produced for 5 hours without causing nozzle clogging.

Toner Example 3

The procedure for preparation of the black toner (b) in Toner Example 2 is repeated except for replacing the wax dispersion W-1 with the wax dispersion W-2. Thus, a black toner (c) is prepared.

The toner (c) has a weight average particle diameter (D4) of 5.0 μm and a very narrow particle diameter distribution (D4/Dn) of 1.01. The toner (c) is continuously produced for 5 hours without causing nozzle clogging.

Toner Example 4

The procedure for preparation of the black toner (b) in Toner Example 2 is repeated except for replacing the wax dispersion W-1 with the wax dispersion W-3. Thus, a black toner (d) is prepared.

The toner (d) has a weight average particle diameter (D4) of 5.5 μm and a relatively wide particle diameter distribution (D4/Dn) of 1.15 compared to toners (a), (b), and (c). The toner (d) is continuously produced for 5 hours while causing slight nozzle clogging in the first 3 hours.

Toner Example 5

The toner components liquid prepared in Toner Example 1 is supplied to the liquid droplet injection unit 2C of the toner production apparatus 1C illustrated in FIG. 22.

The thin film 12 is an SOI substrate having a thickness of 500 μm on which two-step shaped nozzles are provided. Referring to FIGS. 26A to 26D, the nozzle has a first aperture 215 having a diameter of 100 μm and a second aperture 216 having a diameter of 8.5 μm. The thin film 12 is disposed so that the toner components liquid is discharged from the second apertures 216. The distance between each of the nozzles is 100 μm (like hound's-tooth check). The retention part 14 is divided into multiple retention regions 29. The configurations of the retention part 14 are as follows.

Vibration (Resonance) frequency: 32.7 kHz

Number of retention regions: 26

Longitudinal dimension A: 8 mm

Lateral dimension B: 8 mm

Number of nozzles per retention region: 480

The toner components liquid is discharged from the nozzles to form liquid droplets under the following conditions.

Flow rate of dried air: 2.0 L/min for nitrogen gas for dispersion, 30.0 L/min for inner dried nitrogen gas Drying entrance temperature: 60° C.

Drying exit temperature: 45° C.

Dew-point temperature: −20° C.

The discharged liquid droplets are dried into solid mother toner particles. The mother toner particles are suction-collected using a filter having 1 μm-sized fine pores. The mother toner particles are then mixed with 2.0% of a hydrophobized silica (H2000 from Clariant Japan K. K.) using a HENSCHEL MIXER (from Mitsui Mining Co., Ltd.). Thus, a black toner (e) is prepared.

The toner (b) has a weight average particle diameter (D4) of 4.9 μm and a very narrow particle diameter distribution (D4/Dn) of 1.02. The toner (e) is continuously produced for 5 hours without causing nozzle clogging.

Comparative Toner Example 1

The procedure for preparation of the black toner (b) in Toner Example 2 is repeated except for replacing the wax dispersion W-1 with the wax dispersion W-4. Thus, a black toner (f) is prepared.

The toner (f) has a weight average particle diameter (D4) of 4.8 μm and a very narrow particle diameter distribution (D4/Dn) of 1.03. The toner (f) is continuously produced for 5 hours without causing nozzle clogging.

Comparative Toner Example 2

The procedure for preparation of the black toner (b) in Toner Example 2 is repeated except for replacing the wax dispersion W-1 with the wax dispersion W-5. Thus, a black toner (g) is prepared.

The toner (g) has a weight average particle diameter (D4) of 6.0 μm and a wide particle diameter distribution (D4/Dn) of 1.18. The toner (g) is continuously produced for 5 hours while causing slight nozzle clogging in the first 3 hours.

Comparative Toner Example 3

The procedure for preparation of the black toner (b) in Toner Example 2 is repeated except for replacing the wax dispersion W-1 with the wax dispersion W-6. Thus, a black toner (h) is prepared.

The toner (h) has a weight average particle diameter (D4) of 7.0 μm and a wide particle diameter distribution (D4/Dn) of 1.30. The toner (h) is continuously produced for 5 hours while causing nozzle clogging in the first 30 minutes. Accordingly, the toner (h) cannot be subjected to image evaluations described below.

Properties of the toners prepared above are shown in Table 2.

TABLE 2

| | Wax | | Toner properties | | |
|---|---|---|---|---|---|
| Toner | Dispersion | Productivity | Toner | Dv (μm) | Dv/Dn |
| Ex. 1 | W-1 | No clogging | a | 5.3 | 1.02 |
| Ex. 2 | W-1 | No clogging | b | 5.3 | 1.02 |
| Ex. 3 | W-2 | No clogging | c | 5.0 | 1.01 |
| Ex. 4 | W-3 | Slight clogging | d | 5.5 | 1.15 |
| Ex. 5 | W-1 | No clogging | e | 4.9 | 1.02 |
| Comp. Ex. 1 | W-4 | No clogging | f | 4.8 | 1.03 |
| Comp. Ex. 2 | W-5 | Clogging | g | 6.0 | 1.18 |
| Comp. Ex. 3 | W-6 | Clogging | h | 7.0 | 1.30 |

Evaluations (1) Particle Diameter Distribution

The weight average particle diameter (D4) and number average particle diameter (Dn) of toners are measured by a particle size measuring instrument MULTISIZER III (from Beckman Coulter K. K.) with an aperture diameter of 100 μm and an analysis software Beckman Coulter Multisizer 3 Version 3.51. First, 0.5 ml of a 10% by weight surfactant (an alkylbenzene sulfonate NEOGEN SC-A from Dai-ichi Kogyo Seiyaku Co., Ltd.) is contained in a 100-ml glass beaker, and 0.5 g of a toner is added thereto and mixed using a micro spatula. Next, 80 ml of ion-exchange water are further added to prepare a toner dispersion, and the toner dispersion is dispersed using an ultrasonic dispersing machine W-113MK-II (from Honda Electronics) for 10 minutes. The toner dispersion is then subjected to a measurement using a measuring instrument MULTISIZER III and a measuring solution ISOTON-III (from Beckman Coulter K. K.) while the measuring instrument indicates that the toner dispersion has a concentration of 8±2%. It is important to keep the toner dispersion to have a concentration of 8±2% so as not to cause measurement error.

Channels include the following 13 channels: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm; 8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 μm. Namely, particles having a particle diameter of 2.00 μm or more and less than 40.30 μm can be measured.

The volume distribution and number distribution are calculated from the volume and number, respectively, of toner particles thus measured. The weight average particle diameter (D4) and number average particle diameter (Dn) are calculated from the volume distribution and number distribution. The ratio (D4/Dn) of the weight average particle diameter (D4) to the number average particle diameter (Dn) indicates the width of the particle diameter distribution. When the particle diameter distribution is monodisperse, the ratio (D4/Dn) is 1. As the ratio (D4/Dn) increases, the width of the particle diameter distribution increases.

(2) Weight Average Particle Diameter of Wax Dispersion

The weight average particle diameters of wax dispersions are measured using a particle size analyzer MICROTRAC UPA-EX150 (from Nikkiso Co., Ltd.). First, a wax dispersion is diluted with ethyl acetate in a 10-ml glass container so that the diluted wax dispersion has a volume of 8 ml and includes solid components in an amount of 0.5±0.2%. The diluted wax dispersion is subjected to a dispersing treatment using an ultrasonic dispersing machine W-113MK-II (from Honda Electronics) for 1 minute. Subsequently, the diluted wax dispersion is subjected to a measurement using MICROTRAC UPA-EX150 for 30 seconds, setting the refractive index to 1.37 and the particle refractive index to 1.77. The weight average particle diameter of dispersing wax particles is calculated using an analysis software program.

(2) Sharpness

Figure 30:
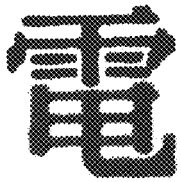
FIG. 30 shows example images with sharpness ranks 1, 3, and 5.
Figure 30:
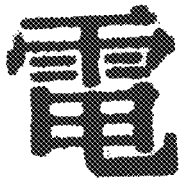
Figure 30:
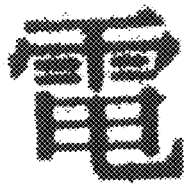

A toner is set in a commercially available copier IMAGIO NEO C320 (from Ricoh Co., Ltd.). An image chart in which 7% of the area is occupied by images is continuously produced on 100,000 sheets of a paper TYPE 6000 (from Ricoh Co., Ltd.). After the 100,000$^{th}$ sheet is printed out, a Chinese character, as illustrated in FIG. 30, with each side having a length of about 2 mm, is printed out and magnified about 30 times. The sharpness of the character is visually observed and graded into 5 levels referring to FIG. 30. Rank 4 and 5 are acceptable for practical use.

(3) Filming

A toner is set in a commercially available copier IMAGIO NEO C320 (from Ricoh Co., Ltd.). An image chart in which 7% of the area is occupied by images is continuously produced on sheets of a paper TYPE 6000 (from Ricoh Co., Ltd.). After the 20,000$^{th}$, 50,000$^{th}$, and 100,000$^{th}$ sheets are produced, the photoreceptor is visually observed whether undesired film of toner is formed (hereinafter "filming problem") or not. Additionally, the resultant images are visually observed whether halftone images are even or not. The results are graded into the following 3 levels.

A: Filming problem does not occur even after the 100,000$^{th}$ sheet is printed out.

B: Filming problem occurs after the 50,000$^{th}$ sheet is printed out.

C: Filming problem occurs after the 20,000$^{th}$ sheet is printed out.

(3) Hot Offset Temperature

A toner is set in a commercially available copier IMAGIO NEO C320 (from Ricoh Co., Ltd.). An image is produced on sheets of a paper TYPE 6000 (from Ricoh Co., Ltd.) while changing the fixing temperature from low to high. The hot offset temperature is a temperature at which image gloss decreases or offset is visually observed for the first time. The results are graded into the following 3 levels.

A: The hot offset temperature is 200° C. or more.

B: The hot offset temperature is from 180 or more and less than 200° C.

C: The hot offset temperature is less than 180° C.

(4) Comprehensive Evaluation

A: Other than the following cases.

B: At least one of the results of "sharpness", "filming", and "hot offset temperature" is B or 3.

C: At least one of the results of "sharpness", "filming", and "hot offset temperature" is C, 2, or 1; or two of the results of "sharpness", "filming", and "hot offset temperature" are B.

Evaluation results are shown in Table 3.

TABLE 3

| | Image Evaluations | | | |
|---|---|---|---|---|
| Toner | Sharpness | Filming | Hot Offset Temperature | Comprehensive Evaluation |
| Ex. 1 | 5 | A | A | A |
| Ex. 2 | 5 | A | A | A |
| Ex. 3 | 5 | A | B | B |
| Ex. 4 | 4 | B | A | B |
| Ex. 5 | 5 | A | A | A |
| Comp. Ex. 1 | 5 | B | C | C |
| Comp. Ex. 2 | 3 | B | A | C |
| Comp. Ex. 3 | | Avaluative | | C |

This document claims priority and contains subject matter related to Japanese Patent Applications Nos. 2008-176606 and 2009-090667, filed on Jul. 7, 2008 and Apr. 3, 2009, respectively, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of producing toner, comprising:

dissolving or dispersing toner components comprising a resin, a colorant, and a release agent in a solvent to prepare a toner components liquid;

discharging the toner components liquid from multiple nozzles provided on a thin film by vibrating the toner components liquid to form liquid droplets of the toner components liquid, such that the liquid droplets are discharged from the multiple nozzles periodically by liquid resonance, wherein the liquid droplets are discharged from the multiple nozzles in a state in which pressure is evenly applied to the toner components liquid within a toner retention part; and drying the liquid droplets into solid particles of a toner, wherein a particle diameter distribution that is a ratio of a weight average particle diameter to a number average particle diameter of the toner is between 1.00 and 1.15, and a weight average particle diameter of the release agent in the toner components liquid is between 1% and 30% of an aperture diameter of the nozzle.

2. The method of producing toner according to claim 1, wherein:

the vibrating is by a circular vibration unit.

3. The method of producing toner according to claim 1, wherein the thin film and the multiple nozzles are provided on a toner retention part, which retains the toner components liquid.

4. The method of producing toner according to claim 1, wherein the vibrating includes vibrating at a frequency of 20 kHz or more and less than 2.0 MHz.

5. The method of producing toner according to claim 1, wherein the vibrating is by a horn vibrator.

6. The method of producing toner according to claim 1, wherein the aperture diameter of the nozzle is from 1 to 40 μm.

7. The method of producing toner according to claim 1, wherein the aperture diameter is defined as a diameter when the aperture of the nozzle is a circle and a minor diameter when the aperture of the nozzle is an ellipse.

8. The method of producing toner according to claim 1, wherein the weight average particle diameter of the release agent in the toner components liquid is between 3% and 20% of the aperture diameter of the nozzle.

9. The method of producing toner according to claim 1, wherein the liquid resonance achieves a vibration resonance in the toner components liquid.

10. The method of producing toner according to claim 9, wherein a frequency of the vibration resonance in the toner components liquid is 32.7 kHz.

11. The method of producing toner according to claim 1, wherein, in the vibrating, the thin film does not achieve a fundamental vibration mode.

* * * * *